US007759037B2

(12) United States Patent
Matsumoto et al.

(10) Patent No.: US 7,759,037 B2
(45) Date of Patent: Jul. 20, 2010

(54) RELEASE AGENT, TONER, AND METHOD FOR MANUFACTURING SAME

(75) Inventors: Katsuru Matsumoto, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 775 days.

(21) Appl. No.: 11/652,485

(22) Filed: Jan. 12, 2007

(65) Prior Publication Data

US 2007/0160923 A1 Jul. 12, 2007

(30) Foreign Application Priority Data

Jan. 12, 2006 (JP) ..... P2006-005235

(51) Int. Cl.
*G03G 9/00* (2006.01)

(52) U.S. Cl. ..... 430/108.1; 430/108.4; 430/109.4

(58) Field of Classification Search ..... 430/108.1, 430/108.4, 109.4
See application file for complete search history.

(56) References Cited

U.S. PATENT DOCUMENTS 6,946,229 B2 * 9/2005 Suzuki et al. ..... 430/109.4

FOREIGN PATENT DOCUMENTS

| | | |
|---|---|---|
| JP | 2002-351140 A | 12/2002 |
| JP | 2004-361817 | 12/2004 |
| JP | 2005-165039 | 6/2005 |
| JP | 2005-316378 A | 11/2005 |

* cited by examiner

*Primary Examiner*—Mark A Chapman
(74) *Attorney, Agent, or Firm*—Nixon & Vanderhye P.C.

(57) ABSTRACT

There are provided a release agent capable of attaining a toner excellent in an anti-offset property and an anti-filming property, without detaching from a kneaded mass even in a case of granulating by heating a dispersion medium containing the kneaded mass, as well as a toner using the release agent and a manufacturing method thereof. A release agent containing a compatible site having compatibility with the binder resin and a releasing site chemically bonded with the compatible site and having the releasing ability is used as the release agent when preparing a kneaded mass by melt-kneading at least a binder resin, a colorant, and a release agent, whereby detachment of the release agent from the kneaded mass can be prevented in producing particles of kneaded mass as the toner particles by mixing the kneaded mass to an aqueous medium prepared and heating and stirring them.

8 Claims, 1 Drawing Sheet

RELEASE AGENT, TONER, AND METHOD FOR MANUFACTURING SAME

CROSS-REFERENCE TO RELATED APPLICATION

This application claims priority to Japanese Patent Application No. JP 2006-5235, which was filed on Jan. 12, 2006, the contents of which, are incorporated herein by reference, in their entirety.

BACKGROUND OF THE INVENTION

1. Field of the Invention

The present invention relates to a release agent used for development of latent images such as static charge images in the process of forming images by electrophotography or the like, to a toner containing the release agent, and to a method for manufacturing the same.

2. Description of the Related Art

In an image forming apparatus for forming images by electrophotography, after forming static charge images, for example, on the surface of an image support such as an electrophotographic photoreceptor (hereinafter also referred to simply as "photoreceptor") by various apparatus, a toner is supplied to develop static charge images and resultant toner images are transferred and fixed on a recording medium such as paper to thereby form images. The toner used for the development of the static charge images (hereinafter referred to as "toner for use in static image development") comprises a resin having a binding property referred to as a binder resin, to which additives such as a colorant, charge controller, etc. are dispersed.

In the recent years, to attempt improvement of image quality, reduction in particle size of toner has been promoted. For example, a toner having an average particle size by volume as small as about 3 to 8 μm has been used. For the manufacture of the toner, a so-called pulverization method has generally been used in which a binder resin, a colorant, etc. are melted and kneaded together and thereafter the resultant kneaded mass is pulverized to obtain a toner. Such a method is disclosed in Japanese Unexamined Patent Publication JP-A 2004-361817, for example. However, the pulverization method involves a problem that the particle shape becomes indefinite as the particle size of the obtained toner is smaller to extremely worsen the powder fluidity. In a case where the powder fluidity of the toner is poor, the toner cannot be supplied stably to the surface of the photoreceptor during development to result in a problem of causing image defects such as unevenness in the density.

Further, the pulverization method involves a problem that it is difficult to make the particle size of the toner uniform and the charging performance of the obtained toner becomes not uniform. In a case of forming images by using a toner of not uniform charging performance, charged amount becomes insufficient to generate a toner not transferred to a transferring material during transfer to the transfer material thereby causing lowering of the image density. For improving the uniformity of the charging performance of the toner in the pulverization method, while it is necessary to conduct classification after pulverization of the kneaded mass to narrow the range for the grain size distribution of the toner, classification results in another problem of lowering the toner yield and increasing the manufacturing cost.

As a method of overcoming the problems described above in the pulverization method, a wet method has been studied.

As described in JP-A 2004-361817, the wet method for obtaining a toner includes, for example, (i) a suspension polymerization method in which monomers of a binder resin dispersed by a suspension stabilizer in water are polymerized under the presence of a colorant and the colorant is incorporated in the resultant binder resin particles, (ii) a coagulation method by emulsion polymerization in which an aqueous dispersion of resin particles obtained by emulsion polymerization of monomers of a binder resin and an aqueous dispersion of a colorant are mixed to form coagulated particles and the resultant coagulated particles are fused under heating, (iii) a phase-inversion emulsification method in which a water dispersible resin and a colorant are dissolved or dispersed in an organic solvent, a neutralizing agent for neutralizing dissociation groups of the water dispersible resin and water are added thereto under stirring to form resin droplets incorporating the colorant, etc. and the resultant resin droplets are subjected to phase-inversion emulsification, (iv) a dissolution suspension method in which a toner material containing a binder resin and a colorant is dissolved or dispersed in an organic solvent to which the binder resin is soluble, the obtained solution or liquid dispersion is mixed with a liquid dispersion of an inorganic dispersant, for example, a less water soluble alkaline earth metal salt such as calcium phosphate or calcium carbonate, the resultant is granulated and then the organic solvent is removed therefrom, and (v) an emulsification and dispersion method in which a binder resin, a colorant, etc. are dissolved or dispersed in a water insoluble organic solvent to which the binder resin is soluble, the obtained solution or liquid dispersion is emulsified and dispersed in an aqueous liquid dispersion and then the organic solvent is removed therefrom.

However, the methods (i) to (v) involve the following problems. For example, the polymerization methods such as (i) suspension polymerization method and (ii) coagulation method by emulsion polymerization involve a problem that the resin usable as the binder resin is restricted to vinyl polymers capable of being formed by radical polymerization since polymerizing reaction is conducted in water. Considering the fixing property of the toner and the transparency thereof in a case of use as a color toner, use of a polyester resin is more preferred to that of the vinyl polymer as the binder resin. As described above, it is preferred that the binder resin is properly selected in accordance with the characteristics required for the toner.

Further, the polymerization method also includes a problem that the monomer of the binder resin, the polymerization initiator, the suspension stabilizer, etc. remain in the inside of the toner particles to make the charging performance of the toner varied. In order to suppress the variation of the charging performance, while it is necessary to remove the residues, it is extremely difficult to remove the monomer, the polymerization initiator, and the suspension stabilizer intruded in the inside of the toner particles.

Further in the phase-inversion emulsification method (iii), the dissolution suspension method (iv), and the emulsion and dispersion method (v), since the organic solvent is used for dissolving or dispersing the binder resin, they require a solvent recovery device for coping with environmental problems to result in a problem that the scale of the manufacturing facility becomes huge. The methods of (iii) to (v) also involve a problem that the resin usable as the binder resin is restricted to water dispersible resins having dissociation groups or those resins soluble to organic solvents.

As a technique for solving the problems, the present applicant has previously proposed a method of melting and kneading a toner starting material such as a binder resin and a colorant, then mixing the resultant kneaded mass into an aqueous medium containing a dispersant and water, heating the aqueous medium mixed with the kneaded mass and stirring the same thereby dispersing the kneaded mass into the aqueous medium and producing particles of the kneaded mass, and separating the particles of the kneaded mass from the aqueous medium to obtain a toner (hereinafter also referred to as "melting emulsification method") (for example in Japanese Unexamined Patent Publication JP-A No. 2005-165039 (pages 4, 8 to 9).

According to the melting emulsification method disclosed in JP-A 2005-165039 described above, since various resins can be used as the binder resin, a toner having a desired characteristic can be manufactured relatively easily. However, with a view point of more reliably obtaining a toner having the desired characteristic, the technique disclosed in JP-A 2005-165039 also leaves a room for the improvement.

In the image forming process, for fixing toner images to a recording medium, a so-called heat roller fixing method of fixing toner images by heating and pressing a recording medium on which toner images are transferred by a heat roller heated to a predetermined temperature thereby fixing toner images has been used frequently. In the heat roller fixing method, an offset phenomenon is liable to occur and, in order to prevent the occurrence of the offset phenomenon, a release agent such as a wax is added to the toner. The offset phenomenon is such a phenomenon that a portion of the toner is transferred from a material to be transferred to a heat roller during fixing and the transferred toner is re-transferred to the subsequent material to be transferred. The offset phenomenon includes a low temperature offset phenomenon and a high temperature offset phenomenon. The low temperature offset phenomenon is an offset phenomenon caused by the occurrence of disconnection of toner images when the toner is not melted sufficiently under heating by the heat roller. The high temperature offset phenomenon is such an offset phenomenon caused by overheating of the toner due to heating by the heat roller to lower the coagulation between the toners to each other and lower the fixing property of the toner images to the recording medium.

In recent years, along with increase in the image forming speed, heating time for the toner by the heat roller during fixing has tended to be shortened. Further, corresponding to the increasing demand for energy saving in the image forming apparatus, it has been required to lower the heating temperature of the heat roller. Accordingly, the low temperature offset phenomenon is liable to occur during fixing and it has been demanded for preventing the low temperature offset phenomenon.

As the release agent for prevent the low temperature offset phenomenon, those capable of fusing at a temperature lower than the softening temperature of the binder resin thereby lowering the melt viscosity of the toner, for example, a wax having a melting point lower than the softening temperature of the binder resin is used. In the melting emulsification method, since the kneaded mass softened by heating is dispersed in an aqueous medium by pulverizing the same under a shearing force by stirring, the aqueous medium mixed with the kneaded mass is heated preferably to higher than the softening temperature of the binder resin contained in the kneaded mass. However, in a case where the temperature of the aqueous medium is higher than the melting point of the wax contained in the kneaded mass, particularly, higher by 20° C. than the melting point of the wax, there is a possibility that the wax is detached from the kneaded mass. Further, since the wax has a poor compatibility with the binder resin, the wax may possibly be detached by the application of a force such as a shearing force on the boundary between the wax and the binder resin in granulating the kneaded mass.

In a case where the wax detached from the kneaded mass and liberated into the aqueous medium (hereinafter also referred to as "free wax") remains in the toner, the free wax adheres to the surface of the image support such as a photoreceptor during development tending to cause a phenomenon referred to as filming in which the wax is fused in the film-like shape. In order to prevent the free wax from remaining, it is necessary to wash the toner particles over and over in the cleaning step after granulating to result in lowering of the productivity. Further, this also results in a problem of yielding a great amount of waste water by cleaning to increase environmental burden.

Further, for granulating the kneaded mass into a desired particle size, since it is necessary to provide a shearing force by stirring the aqueous medium containing the kneaded mass repetitively, this also results in a problem that the wax liberated in the granulating step adheres to the surface of the granulated toner particles. In a case where the free wax adheres in a great amount to the surface of the toner particles, since the melt-viscosity is lowered and the coagulation force between the toner particles to each other is lowered, the high temperature offset phenomenon tends to be caused. Further, since the amount of the wax contained in the toner is decreased by so much as the wax liberated during granulating, even when an appropriate amount of the wax is added while considering the visco-elasticity of the toner so that the low temperature offset phenomenon can be prevented, the visco-elasticity of the toner is deviated from the design due to the detachment of the wax possibly causing the low temperature offset phenomenon. Accordingly, the temperature range of the heat roller capable of fixing the toner (hereinafter referred to as "temperature range capable of fixing") is narrowed and, depending on the case, it is put to a state where the offset phenomenon occurs at any temperature.

As described above, since various problems occur in a case where the release agent such as a wax detaches in granulating the kneaded mass, it has been desired for the method capable of preventing detachment of the wax from the kneaded mass.

SUMMARY OF THE INVENTION

The invention intends to provide a release agent not detaching from the inside of a kneaded mass even in a case of heating a dispersion medium containing the kneaded mass and conducting granulating and capable of providing a toner excellent in an anti-offset property and an anti-filming property, as well as a toner using the release agent, and a manufacturing method thereof.

The invention provides a release agent for use in a toner obtained in such a manner that particles of a kneaded mass are produced by mixing the kneaded mass containing at least a binder resin, a colorant and a release agent with a dispersion medium, heating and stirring the dispersion medium mixed with the kneaded mass, and that the granulated particles of the kneaded mass are separated from the dispersion medium, the release agent comprising a compatible site having compatibility with a binder resin and a releasing site chemically bonding with the compatible site and having releasing ability.

According to the invention, the release agent includes a compatible site having compatibility with the binder resin and the releasing site chemically bonding with the compatible site and having releasing ability. Since the release agent of the invention can lower the melt-viscosity of the toner comprising the granulated particles of the kneaded mass containing the binder resin, the colorant, and the release agent by the softening or the melting of the releasing site when the toner containing the release agent of the invention is heated and fixed, it is possible to lower the temperature at which the low temperature offset phenomenon starts to occur (hereinafter referred to as "starting temperature for low temperature offset") and improve the anti-low temperature offset property. Further, since the release agent of the invention is compatible with the binder resin at the compatible site, the release agent is not detached from the kneaded mass into the dispersion medium in producing the particles of the kneaded mass by heating and stirring the dispersion medium mixed with the kneaded mass at least containing the binder resin, the colorant and the release agent. Accordingly, the release agent of the invention does not cause the high temperature offset phenomenon and filming on the photoreceptor due to deposition of the liberated release agent to the granulated particles of the kneaded mass. Therefore, by using the release agent of the invention, since detachment of the release agent during manufacture can be prevented, it is possible to provide a toner having a desired visco-elasticity, with a broader temperature range capable of fixing compared with a case of not using the release agent of the invention and not causing the filming on the photoreceptor easily and stably.

Further, in the invention, it is preferable that the release agent is composed of a branched resin having a main chain and side chains, the main chain contains a compatible site and the side chains contain the releasing site.

According to the invention, the release agent is composed of a branched resin having a main chain containing a compatible site and side chains containing a releasing site. Since this can increase the ratio of the releasing site to the release agent compared with a release agent comprising a resin in which the main chain contains a compatible site and a group containing a releasing site is bonded as a terminal group to the terminal end of the main chain containing the compatible site, a release agent capable of reliably lowering the starting temperature for low temperature offset can be obtained. Further, since the release agent can be dispersed as micelles in the kneaded mass, with the releasing site being coagulated, the main chain containing the compatible site being directed to the binder resin and the side chains containing the releasing site being directed inward of the main chain, the compatibility between the release agent and the binder resin can be prevented from excessively increasing. Then, since the releasing site can be dispersed in the binder resin as domains with such a dispersion particle size as capable of developing the releasing ability, for example, with the dispersion particle size of 0.1 μm or more and 0.8 μm or less, the starting temperature for low temperature offset can be lowered more reliably as compared with a case of using a release agent comprising a resin in which a group containing the releasing site is bonded as a terminal group to the terminal end of the main chain containing the compatible site. Further, the temperature at which the high temperature offset phenomenon starts to occur (hereinafter referred to as "starting temperature for high temperature offset") can be made higher to improve the anti-high temperature offset property. Accordingly, the temperature range capable of fixing can be extended.

Further, in the invention, it is preferable that the release agent is obtained by reacting a reactive resin a main chain of which contains a compatible site and side chains of which have reactive functional groups and a releasing compound having reactive functional groups capable of reacting with the reactive functional groups of the reactive resin and having releasing ability such that a reactivity of the reactive functional group of the reactive resin is 90% or more.

According to the invention, the release agent is obtained by reacting a reactive resin a main chain of which contains a compatible site and side chains of which have reactive functional groups and a releasing compound having reactive functional groups capable of reacting with the reactive functional groups of the reactive resin and having releasing ability at a reactivity of the reactive functional groups of the reactive resin of 90% or more. Thus, by reacting the reactive resin and the releasing compound so that the reactivity of the reactive functional groups on the side chains of the reactive resin is 90% or more, , a release agent can be obtained more reliably which comprises a branched resin having the compatible site in the main chain, and the side chains on which the releasing compound is bonded as the releasing site. By using such a release agent, it can be dispersed as micelles in the kneaded mass more reliably with releasing site being coagulated, the main chain containing the compatible site being directed to the binder resin, and the side chains containing the releasing sites being directed inward of the main chain. Since, this can improve the compatibility between the release agent and the binder resin, detachment of the release agent from the kneaded mass can be prevented more reliably, and the high temperature offset phenomenon and the occurrence of filming on the photoreceptor due to the deposition of the liberated release agent to the granulated particles of the kneaded mass can be prevented more reliably. Further, since the dispersed particle size for the releasing site of the release agent in the kneaded mass can be defined within such a range as capable of developing the releasing ability more reliably, the anti-low temperature offset property and the anti-high temperature offset property of the toner (hereinafter sometimes collectively referred to as "anti-offset property") can be improved.

Further, the invention, it is preferable that a weight average molecular weight of the side chains containing the releasing site is 500 or more and 5,000 or less.

Further, according to the invention, the weight average molecular weight of the side chains containing the releasing site is 500 or more and 5,000 or less. Since this can make the coagulation force between each of the releasing sites favorable and the dispersed particle size for the releasing site of the release agent in the kneaded mass into a range suitable to the development of the releasing ability, a release agent capable of improving the anti-offset property more reliably can be attained. Further, since the viscosity of the releasing site of the release agent when it is softened or melted can be made within a range suitable to lowering the melt-viscosity of the toner, the starting temperature for low temperature offset can be lowered more reliably.

Further, in the invention, it is preferable that the weight average molecular weight in the main chain is 2,500 or more and 50,000 or less.

According to the invention, the weight average molecular weight of the main chain is 2,500 or more and 50,000 or less. Since this can prevent excessive increase in the compatibility between the main chain and the binder resin and can control the dispersion particle size for the releasing site of the release agent in the kneaded mass more reliably to be within such a range that the releasing site can develop the releasing ability, the release agent capable of improving the anti-offset property can be attained more reliably.

In this case, the weight average molecular weight of the main chain is a weight average molecular weight of the resin as the main chain before introduction of the side chains. Further, the weight average molecular weight of the side chain means a value obtained by subtracting the weight average molecular weight of the main chain from the weight average molecular weight the resin obtained by introducing the side chains to the resin as the main chain and, further, dividing the same with a branching degree.

Further, in the invention, it is preferable that the compatible site is formed of a resin containing a constituent unit identical with a constituent unit constituting the binder resin.

According to the invention, the compatible site of the release agent is formed of a resin containing a constituent unit identical with that of the constituent unit constituting the binder resin. Since this can improve the compatibility between the compatible site of the release agent and the binder resin, this can more reliably prevent detachment of the release agent from the kneaded mass in heating the dispersion medium mixed with the kneaded mass containing the binder resin, the colorant, and the release agent.

Further, in the invention, it is preferable that a release agent for use in a toner containing a polyester resin as a binder resin in which a compatible site is formed of a polyester resin and a releasing site is formed of an ester compound having an ester bond.

In the release agent according to the invention, since the compatible site is formed of the polyester resin and the releasing site is formed of the ester compound having the ester bond, it is excellent in the compatibility with the polyester resin. Accordingly, by using the release agent of the invention as a starting material for a toner containing the polyester resin as the binder resin, detachment of the release agent from the kneaded mass can be prevented more reliably in heating the dispersion medium mixed with the kneaded mass containing the binder resin, the colorant, and the release agent.

Further, the invention provides a method for manufacturing a toner comprising a melt-kneading step of preparing a kneaded mass by mixing and melt-kneading at least a binder resin, a colorant and a release agent; a granulating step of producing particles of kneaded mass by mixing a kneaded mass containing at least a binder resin, a colorant and a release agent with a dispersion medium, heating and stirring the dispersion medium mixed with the kneaded mass; and a separation step of separating the granulated particles from the dispersion medium, wherein in the melt-kneading step the release agent mentioned above is used as a release agent.

According to the invention, the toner is manufactured by way of the melt-kneading step, the granulating step, and the separation step. In the melt-kneading step, at least the binder resin, the colorant, and the release agent are melt-kneaded to prepare a kneaded mass. In the granulating step, the kneaded mass obtained in the melt-kneading step is mixed with a dispersion medium, the dispersion medium mixed with the kneaded mass is heated and stirred, thereby dispersing the kneaded mass in the dispersion medium to produce particles of a kneaded mass as the toner particles. In the separation step, the granulated particles of the kneaded mass in the granulating step, that is, the toner particles are separated from the dispersion medium. The toner particles separated from the dispersion medium are produced into a toner, as they are or with external addition of an external additive such as a surface modifying agent.

In the melt-kneading step, since the release agent of the invention containing the compatible site having compatibility with the binder resin and the releasing site chemically bonded with the compatible site and having releasing ability is used, detachment of the release agent from the kneaded mass can be prevented in producing the particles of the kneaded mass by heating and stirring the dispersion medium mixed with the kneaded mass in the granulating step. Accordingly, occurrence of the high temperature offset phenomenon and the filming on the photoreceptor due to the deposition of the liberated release agent to the granulated particles can be prevented. Accordingly, a toner having a desired visco-elasticity, with a wider temperature range capable of fixing compared with a case of not using the release agent of the invention and not causing filming on the photoreceptor can be provided stably.

The toner particles are particles obtained by granulating a kneaded mass containing at least a binder resin, a colorant, and a release agent. The toner means toner particles per se in a case where an external additive such as a surface modifying agent is added externally to the toner particles and means a composition containing toner particles and an external additive in a case of externally adding the external additive such as the surface modifying agent to the toner particles.

Further, the invention provides a toner obtained in such a manner that particles of a kneaded mass are produced by mixing the kneaded mass containing at least a binder resin, a colorant and a release agent with a dispersion medium, heating and stirring the dispersion medium mixed with the kneaded mass, and that the granulated particles are separated from the dispersion medium, the toner comprising the release agent mentioned above.

According to the invention, the toner is obtained in such a manner that particles of a kneaded mass are produced by mixing a kneaded mass containing at least a binder resin, a colorant and the release agent mentioned above with a dispersion medium, heating and stirring the dispersion medium mixed with the kneaded mass, and the granulated particles are separated from the dispersion medium. Since the release agent of the invention contains the compatible site having compatibility with the binder resin and the releasing site bonded with the compatible site and having releasing ability, it is not detached from the kneaded mass in producing particles of kneaded mass by heating and stirring the dispersion medium mixed with a kneaded mass. Accordingly, by using the release agent of the invention, a toner having a desired visco-elasticity, with a wider temperature range capable of fixing compared with a case of not using the release agent of the invention and not causing filming on the photoreceptor can be obtained.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
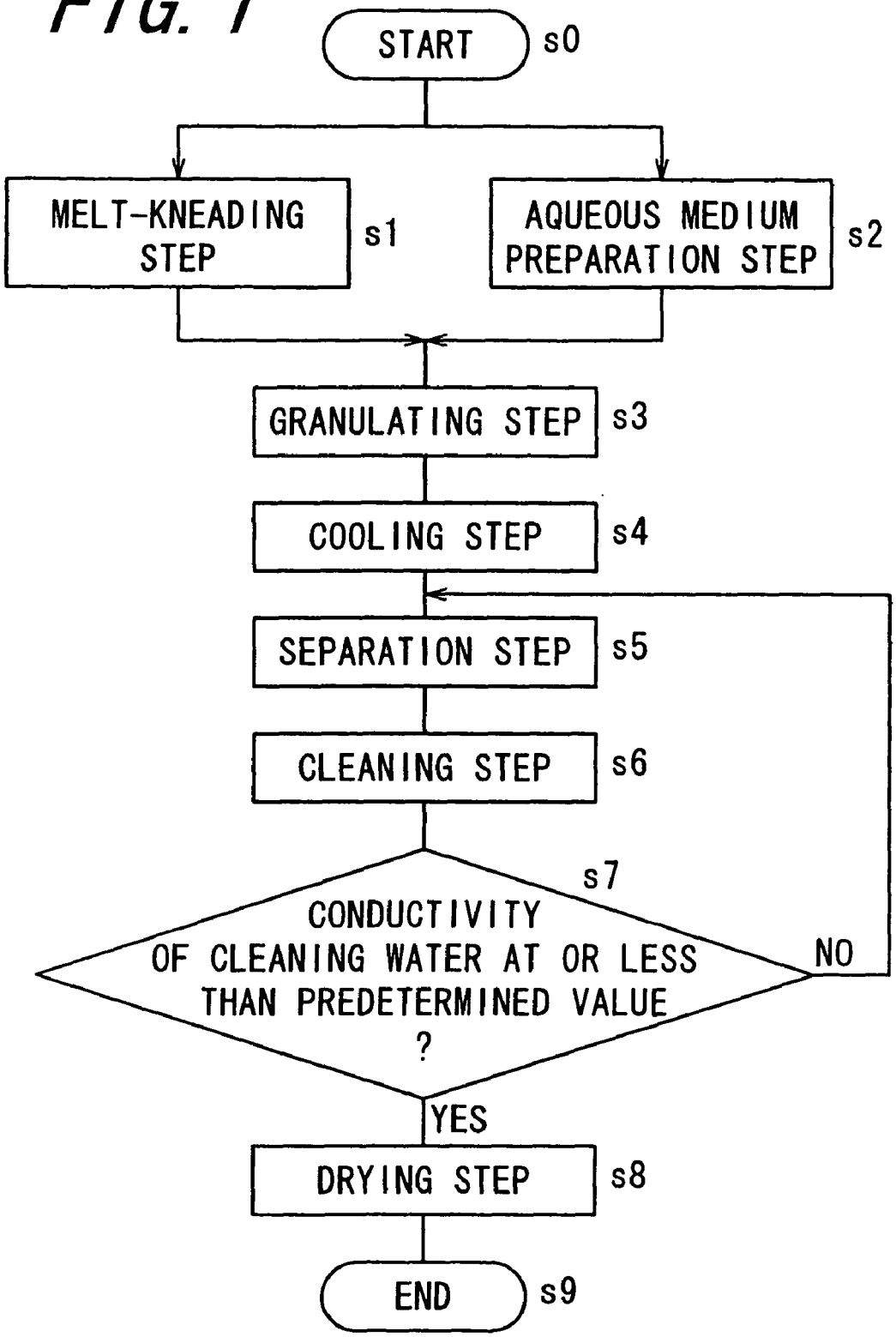
FIG. 1 is a flow chart showing steps of a method for manufacturing a toner as one embodiment of the invention.

Now referring to the drawings, preferred embodiments of the invention are described below.

The release agent of the invention is a release agent used suitably for a toner obtained in such a manner that particles of a kneaded mass are produced by mixing a kneaded mass containing at least a binder resin, a colorant and a release agent with a dispersion medium, heating and stirring the dispersion medium mixed with the kneaded mass, and that the granulated particles are separated from the dispersion medium, and the release agent comprises a compatible site having compatibility with a binder resin and a releasing site chemically bonding with the compatible site and having releasing ability.

Since the release agent of the invention has the releasing site having releasing ability, the releasing site is softened or melted to lower the melt-viscosity of the toner and lower the starting temperature for low temperature offset and improve the anti-low temperature offset property when the toner is fixed by a heat roller fixing method while incorporating the same into the toner. Further, it can provide the toner with the releasing ability, increase the starting temperature for high temperature offset and improve the anti-high temperature offset property. Further, since the release agent of the invention has a compatible site having compatibility with the binder resin, it is compatible with the binder resin at the compatible site. Since the compatible site is chemically bonded with the releasing site, this can prevent the detachment of the release agent from the kneaded mass in granulating the kneaded mass containing the binder resin, the colorant, and the release agent even when the dispersion medium mixed with the kneaded mass is heated to a temperature higher than the softening temperature or melting temperature of the releasing site of the release agent. Since this can prevent the liberated release agent from depositing on the toner particles which are the granulated particles of the kneaded mass, it is possible to prevent lowering of the coagulation force between the toner particles to each other due to softening or melting of the releasing site of the release agent deposited on the surface of the toner particles, prevent lowering of the starting temperature for high temperature offset and improve the anti-high temperature offset property. Further, since the liberated release agent can be prevented from remaining on the toner, filming on the photoreceptor can be prevented.

Accordingly, since detachment of the release agent during manufacture can be prevented by using the release agent of the invention, a toner having a desired visco-elasticity, having a wider temperature range capable of fixing compared with a case of not using the release agent of the invention and not causing filming on the photoreceptor can be provided easily and stably.

In the release agent of the invention, the melting point of the releasing site is preferably 40° C. or higher and 120° C. or lower. In a case where the melting point of the releasing site is lower than 40° C., the store stability of the toner manufactured by using the release agent of the invention tends to be lowered and heat coagulation between toner particles to each other tends to occur in a container compared with a case where the melting point of the releasing site is 40° C. or higher. In a case where the melting point of the releasing site exceeds 120° C., since the releasing site becomes less melted compared with the case where the melting point of the releasing site is 120° C. or lower, the temperature range capable of fixing the toner manufactured by using the release agent of the invention may possibly be narrowed. "Melting point of the releasing site" means herein a temperature at the apex of the melting peak in differential scanning calorimetry (simply referred to as DSC) for the releasing site. In a case where the release agent of the invention is a resin that can be obtained by bonding the resin compatible with the binder resin with the releasing compound as will be described later, "melting point of releasing site" means the melting point of the releasing compound as the starting material for the release agent of the invention.

Further, in the release agent of the invention, the softening point (Tm) of the releasing site is preferably 60° C. or higher and 100° C. or lower. In a case where the softening temperature (Tm) of the releasing site is lower than 60° C., the releasing site tends to be softened or melted and the toner manufactured by using the release agent of the invention may possibly cause heat coagulation in the container compared with a case where the softening temperature (Tm) of the releasing site is 60° C. or higher. In a case where the softening temperature (Tm) of the releasing site exceeds 100° C., the releasing site is not softened or melted sufficiently in fixing the toner manufactured by using the release agent of the invention compared with a case where the softening temperature (Tm) of the releasing site is lower than 100° C., to result in a possibility that the effect of the invention of improving the anti-offset property cannot be provided sufficiently. In a case where the release agent of the invention is a resin obtained by bonding a releasing compound to a resin compatible with the binder resin to be described later, "softening temperature" (Tm) of the releasing site means a softening temperature (Tm) of the releasing compound as the starting material for the release agent of the invention.

Further, in the release agent of the invention, the glass transition temperature (Tg) of the releasing site is preferably 30° C. or hither and 80° C. or lower. In a case where the glass transition temperature (Tg) of the releasing site is lower than 30° C., the store stability of the toner manufactured by using the release agent of the invention is lowered compared with the case where the glass transition temperature (Tg) of the releasing site is 30° C. or higher tending to cause heat coagulation between toner particles to each other in the toner container to possibly result in printing failure. In a case where the glass transition temperature (Tg) of the releasing site exceeds 80° C., the releasing site becomes less softened or melted and the toner cannot be provided with a sufficient releasing ability compared with a case where the glass transition temperature (Tg) of the releasing site is 80° C. or lower, to result in a possibility that the effect of the release agent of the invention of increasing the starting temperature for high temperature offset cannot be provided sufficiently. In a case where the release agent of the invention is a resin obtained by bonding the releasing compound to the resin compatible with the binder resin as will be described later, "glass transition temperature (Tg) of releasing site" means the glass transition temperature (Tg) of the releasing compound as the starting material for the release agent of the invention.

The release agent of the invention includes, for example, a resin obtained by bonding a compound having releasing ability (hereinafter referred to as "releasing compound") to the terminal end of a resin compatible with the binder resin and a resin obtained by bonding a releasing compound as a side chain to a resin compatible with the binder resin. Among them, a resin obtained by bonding a releasing compound as the side chain to a resin compatible with the binder resin, that is, a branched resin having a main chain and side chains in which the main chain contains a compatible site and the side chains contain a releasing site is preferable.

As described above, the release agent comprising a branched resin in which the main chain contains the compatible site and the side chains contain the releasing site can increase the ratio of the releasing site in the release agent compared with a resin obtained by bonding a releasing compound to the terminal end of a resin compatible with a binder resin, that is, a release agent comprising a resin in which a group containing a releasing site is bonded as a terminal group to the terminal end of the main chain containing the compatible site. For example, by increasing the number of side chains containing the releasing site to be bonded to the main chain, the ratio of the releasing site of the release agent can be increased. Accordingly, a release agent capable of reliably lowering the starting temperature for low temperature offset can be obtained by a branched resin in which the main chain contains the compatible site and the side chains contain the releasing site.

Further, by constituting the release agent of the invention with a branched resin, and incorporating the releasing site to the side chains of the branched resin, it can be dispersed as micelles with the releasing sites being coagulated to each other, the main chain containing the compatible site being directed to the binder resin and the side chains containing the releasing site (hereinafter also referred to as "releasing side chain") being directed inward of the main chain in the kneaded mass. This can prevent the excessive increase of the compatibility between the release agent and the binder resin compared with the case of bonding the group containing the releasing site as the terminal group to the terminal end of the main chain containing the compatible site.

On the other hand, in a case of a release agent comprising a resin in which a group containing the releasing site is bonded as a terminal group to the terminal end of the main chain containing the compatible site, coagulation between the releasing sites to each other is lowered and the release agent does not form micelles in the kneaded mass, but the releasing site is in direct contact with the binder resin to possibly increase the compatibility excessively between the release agent and the binder resin. In a case where the compatibility between the release agent and the binder resin increases excessively, the releasing site of the release agent no more shows the melting point or softening temperature inherent to the releasing site and the releasing ability cannot possibly be developed. In order that the releasing site maintains the inherent melting point or the softening temperature and develops the releasing ability, it is necessary that the releasing site is dispersed at an appropriate dispersion particle size in the binder resin.

As described above, by constituting the release agent of the invention with the branched resin and incorporating the releasing site in the side chains of the branched resin, the compatibility between the release agent and the binder resin is prevented from increasing excessively, and the releasing site can be dispersed as domains in the binder resin at such a dispersion particle size as developing the releasing ability, specifically, at a dispersion particle size of 0.1 μm or more and 0.8 μm or less and, preferably, 0.1 μm or more and 0.7 μm or less. Accordingly, when the toner is fixed by the heat roller fixing method, since the function as the release agent can be developed to provide the toner with the releasing ability to the heat roller, it is possible to increase the starting temperature for high temperature offset and improve the anti-high temperature offset property. Further, the starting temperature for low temperature offset can be lowered more reliably. Accordingly, the temperature range capable of fixing the toner can be widened more compared with a case of not using the release agent of the invention.

As described above, in a case where the release agent of the invention comprises a branched resin comprising a branched resin in which the main chain contains a compatible site and the side chains contain a releasing site, the release agent of the invention is preferably a release agent obtained by using a reactive resin in which the main chain contains a compatible site and the side chains contain a reactive functional group as the resin compatible with the binder resin described above, and reacting the reactive resin and a releasing compound having a reactive functional group capable of reacting with the reactive functional groups of the reactive resin such that the reactivity of the reactive functional groups of the reactive resin is 90% or more. A release agent comprising the branched resin in which the main chain contains the compatible site and the releasing compound is bonded as the releasing site to the side chains can be obtained more reliably by reacting the reactive resin and the releasing compound such that the reactivity of the reactive functional groups on the side chains of the reactive resin (hereinafter also referred to as "side chain reactivity") is 90% or more. By using the release agent of the invention obtained as described above, it can be dispersed as micelles more reliably, with the releasing sites being coagulated to each other, the main chain containing the compatible site being directed to the binder resin, and the releasing side chains being directed inward of the main chain in the kneaded mass. Since this can improve the compatibility between the release agent and the binder resin, detachment of the release agent from the kneaded mass can be prevented more reliably in heating the dispersion medium containing the kneaded mass. Accordingly, occurrence of the high temperature offset phenomenon and the filming on the photoreceptor due to the detachment of the release agent can be prevented more reliably. Further, since the release agent of the invention can be dispersed as micelles in the kneaded mass, the dispersion particle size in the releasing site of the release agent in the kneaded mass can be within such a range as capable of developing the releasing ability more reliably. Accordingly, since the starting temperature for high temperature offset can be increased more reliably, the anti-high temperature offset property for the toner can be improved. Further, since the starting temperature for low temperature offset can be lowered more reliably, the anti-low temperature offset property can be improved. Accordingly, the temperature range capable of fixing the toner can be widened more reliably compared with a case of using the release agent obtained by reacting the reactive resin and the releasing compound under such a condition that the side chain reactivity is less than 90%.

In a case where the side chain reactivity of the reactive resin is less than 90% when the release agent of the invention is manufactured by reacting the reactive resin having the reactive functional groups on the side chains and the releasing compound, a great amount of the releasing compound not bonded to the reactive resin is contained in the obtained release agent to possibly cause detachment from the kneaded mass in the granulating step. Further, by the lowering of the ratio of the releasing compound bonded on the side chains, coagulation property between the releasing sites to each other formed with the releasing compound is lowered and the release agent does not possibly form micelle in the kneaded mass to possibly result in a state where the releasing site is in direct contact with the binder resin. This may render the compatibility insufficient between the release agent and the binder resin to possibly detach the release agent from the kneaded mass. Further, the dispersion particle size of the releasing site of the release agent is deviated to less than the suitable range for developing releasing ability to result in a possibility that the releasing ability cannot be provided sufficiently to lower the anti-high temperature offset property of the toner. Further, the anti-low temperature offset property of the toner may possibly be lowered by the detachment of the release agent and the releasing compound in the granulating step.

The weight average molecular weight of the side chains containing the releasing site, that is, the releasing side chain of the release agent comprising the branched resin is preferably 500 or more and 5,000 or less. By defining the weight average molecular weight of the releasing side chains to 500 or more and 5,000 or less, since the coagulation force between each of the releasing sites can be made favorable and the dispersion particle size of the releasing site of the release agent in the kneaded mass can be made within a range suitable to the development of the function as the release agent, the starting temperature for high temperature offset can be increased more reliably. Further, since the viscosity of the releasing site of the release agent when it is softened or melted can be made within a range suitable to lowering of the melt-viscosity of the toner, the starting temperature for low temperature offset can be lowered more reliably.

In a case where the weight average molecular weight of the releasing side chains in the release agent comprising the branched resin is less than 500, the coagulation force of the releasing site is lowered, the dispersion particle size of the releasing site is deviated to less than the range suitable to the development of the function as the release agent to possibly lower the anti-high temperature offset property. In a case where the weight average molecular weight of the releasing side chains exceeds 5,000, the viscosity of the release agent when the releasing site is melted becomes excessively high and the effect of lowering the melt-viscosity of the toner cannot be provided sufficiently and the anti-low temperature offset property is lowered to possibly increase the starting temperature for low temperature offset.

The weight average molecular weight of the main chain in the release agent comprising the branched resin is preferably 2,500 or more and 50,000 or less. By defining the weight average molecular weight of the main chain to 2,500 or more and 50,000 or less, it is possible to prevent the compatibility between the main chain and the binder resin from increasing excessively, and the dispersion particle size of the releasing site of the release agent in the kneaded mass can be within such a range that the releasing site can develop the releasing ability. Accordingly, a release agent capable of improving the anti-offset property more reliably can be attained.

In a case where the weight average molecular weight of the main chain exceeds 50,000, compatibility between the main chain and the binder resin increases excessively, the release agent cannot be dispersed as micelles in the kneaded mass, the dispersion particle size of the releasing site of the release agent is deviated to less than the range capable of developing the releasing ability to result in a possibility that the high temperature offset phenomenon cannot be prevented. In a case where the weight average molecular weight of the main chain is less than 2,500, compatibility between the compatible site contained in the main chain and the binder resin is insufficient to possibly cause detachment of the release agent from the kneaded mass in heating the dispersion medium mixed with the kneaded mass.

In the release agent comprising the branched resin, the ratio of the weight average molecular weight Mb of the releasing side chains relative to the weight average molecular weight Ma of the main chain (Mb/Ma; hereinafter also simply referred to as "Mb/Ma") is preferably 0.01 or more and 0.90 or less and, more preferably, 0.01 or more and 0.50 or less. In a case where the ratio Mb/Ma is less than 0.01, the coagulation force of the releasing site is lowered, the dispersion particle size of the releasing site is deviated to less than a range suitable to the development of the function as the release agent to possibly lower the anti-high temperature offset property. In a case where the ratio Mb/Ma exceeds 0.90, viscosity of the release agent is excessively high when the releasing site is softened or melted, and the effect of lowering the melt-viscosity of the toner cannot be provided sufficiently and the anti-low temperature offset property is lowered to possibly increase the starting temperature for low temperature offset.

In a case where the release agent of the invention comprises a resin obtained by bonding the releasing compound to the terminal end of the resin compatible with the binder resin, the weight average molecular weight of the releasing compound as the terminal group is, preferably, 500 or more and 5,000 or less with the same reason as that for the weight average molecular weight of the releasing side chains in the branched resin. Further, the weight average molecular weight of the resin to which the releasing compound is bonded is preferably 2,500 or more and 50,000 or less with the same reason as that for the weight average molecular weight of the main chain in the branched resin. Further, the ratio of the weight average molecular weight Mb' of the releasing compound relative to the weight average molecular weight Ma' of the resin (Mb'/Ma') is preferably 0.01 or more and 0.90 or less.

The compatible site of the release agent of the invention is preferably formed of a resin containing a constituent unit of the type identical with the constituent unit constituting the binder resin contained in the kneaded mass. For example, in a case of the toner containing a polyester resin as the binder resin, the compatible site is preferably formed of a polyester resin. As described above, by constituting the compatible site of the release agent with a resin containing a constituent unit of a type identical with the constituent unit constituting the binder resin contained in the kneaded mass, since the compatibility between the compatible site and the binder resin of the release agent can be improved, detachment of the release agent from the kneaded mass can be prevented more reliably in heating the dispersion medium mixed with the kneaded mass.

The release agent of the invention can be manufactured, for example, by reacting a reactive resin having reactive functional groups with a releasing compound having reactive functional groups capable of reacting with the reactive functional groups of the reactive resin. The reactive resin and the releasing compound can be bonded, for example, by way of an ester bond, urea bond, or urethane bond.

As the releasing compound, wax or the like can be used. The wax used as the releasing compound includes known waxes used for the release agent of the toner and includes, specifically, polyolefin waxes such as polypropylene and polyethylene, synthesis waxes such as Fischer-Tropsch wax, alcohol wax, and ester wax, as well as coal waxes such as montane wax, petroleum waxes such as paraffin wax, and natural waxes such as plant waxes, for example, carnauba wax and rice wax. The carnauba wax is a natural wax having ester groups.

Among the waxes described above, ester waxes are preferred. The ester wax is an ester compound of a fatty acid and an alcohol.

The ester wax can be synthesized by polycondensating reaction of a fatty acid and an alcohol. For example, an ester wax can be synthesized in the same manner as in the case of synthesizing a polyester resin to be described later, by subjecting a fatty acid and an alcohol to polycondensating reaction, specifically, dehydrating condensating reaction in an organic solvent or with no solvent under the presence of a catalyst. The polycondensating reaction may be terminated at the instance the acid value and the hydroxyl value, as well as the melting point of the resultant ester wax reach predetermined values in the polycondensating reaction. The amount of the carboxyl groups and the hydroxyl groups bonded, for example, to molecular chain terminal ends of the obtained ester wax, that is, the acid value and the hydroxyl value of the obtained ester wax can be controlled by properly selecting the kind and the blending ratio, and the reactivity of the fatty acids and the alcohols as the starting materials for the ester wax. Further, other physical property values such as the melting point and the melt-viscosity can also be controlled.

As described above, in the case of the ester wax, by property selecting the kind, the blending ratio, and the reactivity of the fatty acid and the alcohol as the starting materials for the ester wax, the kind and the amount of the reactive functional groups, and physical property values such as the melting point and the melt-viscosity of the obtained ester wax can be controlled easily. Accordingly, ester waxes are particularly preferred as the releasing compound.

Among the ester waxes, esters of linear saturated monocarboxylic acids and linear saturated monohydric alcohols or polyhydric alcohols are preferred, and linear saturated monocarboxylic acids with the number of carbon atoms of 14 or more and 30 or less and esters of linear saturated monohydric alcohols with the number of carbon atoms of 14 or more and 30 or less or polyhydric alcohols with the number of carbon atoms of 2 or more and 30 or less are further preferred.

The linear saturated monocarboxylic acid includes, for example, myristic acid (tetradecanoic acid), palmitic acid (hexadecanoic acid), stearic acid (octadecanoic acid), arachic acid (eicosanoic acid), behenic acid (docosanoic acid), lignoceric acid (tetracosanoic acid), cerotinic acid (hexacosanoic acid), montanic acid (octacosanoic acid), and melissic acid (triacontanoic acid).

The linear saturated monohydric alcohol includes, for example, myristyl alcohol, cetyl alcohol, stearyl alcohol, arachidicalcohol, behenylalcohol, tetracosanol, hexacosanol, octacosanol, and triacontanol.

The polyhydric alcohol includes, for example, polyhydric alcohols of di or more and hexa or less valence number. The dihydric alcohol includes ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexanedimethanol, spiroglycol, 1,4-phenyleneglycol, 2,2-bis (p-hydroxyphenyl)propane (also referred to as bisphenol A), and hydrogenated bisphenol A. The trihydric alcohol includes those of 2 or more and 30 or less of carbon atoms such as 1,2,4-butanetriol, 1,2,5-pentanetriol, 2-methyl-1,2,4-butanetriol, glycerin, 2-methylpropanetriol, trimethylol ethane, triethylol ethane, trimethylol propane, and 1,3,5-trihydroxmethyl benzene. The tetrahydric alcohol includes, for example, 1,2,3,6-hexanetetraol and pentaerythritol. The pentahydric alcohol includes, for example, glucose. The hexahydric alcohol includes, for example, dipentaerythritol.

The ester wax can be prepared, for example, by conducting esterifying reaction using a fatty acid in excess to the alcohol described above, and then removing the excess fatty acid in the obtained esterified crude product by deacidification using an aqueous alkali solution. Further, the ester wax described above is commercially available and commercial products include, for example, WEP-5 and WEP-8 (trade name of product) manufactured by NOF Corp., with no particular restriction thereto. For the ester wax, those ester resins commercially available as polyester resins may also be used. The polyester resin usable as the ester wax includes polyester resin having a waxy property and, more specifically, it includes polyester resins with the number average molecular weight of 500 or more and 5,000 or less. The number average molecular weight is a value converted as polystyrene measured by gel permeation chromatography (simply referred to as GPC).

The releasing compound such as the ester wax is used for the reaction with the reactive resin as it is in a case where it has the reactive functional group, or after introduction of a reactive functional group if it has no reactive functional group (hereinafter, it is referred to as "releasing compound" also including the releasing compound introduced with the reactive functional group unless otherwise specified). Further, a releasing compound inherently having the reactive functional group such as the ester wax may also be used with introduction of the reactive functional group different from the reactive functional group present inherently. The reactive functional group introduced into the releasing compound in the course of the synthesis or after the synthesis includes, for example, carboxyl group, hydroxyl group, amino group, and urea group.

In a case of the releasing compound inherently having the reactive functional group such as the ester wax, the reactive functional group can be introduced, for example, by reacting the monomer having the functional group during polymerization. Further, in a case of a releasing compound not having the reactive functional group such as an olefin wax or paraffin wax, a reactive functional group such as a hydroxyl group (OH group) can be introduced, for example, by an oxidizing treatment. For example, in a case of the olefin wax, the hydroxyl group or the like can be introduced by thermally decomposing the olefin wax while controlling the oxidizing condition during thermal decomposition.

The amount of the reactive functional group of the releasing compound can be measured, for example, based on the acid value or the hydroxyl value. The acid value of the releasing compound having the carboxyl group as the reactive functional group is preferably 30 mgKOH/g or more and 70 mgKOH/g or less. In a case where the acid value is less than 30 mgKOH/g, the amount of the carboxyl group as the reactive functional group is decreased compared with the case where the acid value is 30 mgKOH/g or more, and there is a possibility that the reaction with the reactive resin less proceeds. In a case where the acid value exceeds 70 mgKOH/g, the amount of the carboxylic group as the reactive functional group increases excessively compared with a case where the acid value is 70 mgKOH/g or less possibly making it difficult to control the reactivity with the reactive resin. Reaction with the reactive resin can be proceeded more reliably by using a releasing compound with the acid value of 30 mgKOH/g or more and 70mgKOH/g or less. Further, since the reactivity with the reactive resin can be controlled easily, the physical property value of the release agent of the invention can be controlled easily.

The hydroxyl group value of the releasing compound having the hydroxyl group as the reactive functional group is preferably 30 mgKOH/g or more and 70 mgKOH/g or less. In a case where the hydroxyl value is less than 30 mgKOH/g, the amount of the hydroxyl group as the reactive functional group is decreased compared with the case where the hydroxyl group value is 30 mgKOH/g or more, and there is a possibility that the reaction with the reactive resin less proceeds. In a case where the hydroxyl group value exceeds 70 mgKOH/g, the amount of the hydroxyl group as the reactive functional group increases excessively compared with a case where the hydroxyl group value is 70 mgKOH/g or less possibly making it difficult to control the reactivity with the reactive resin. Reaction with the reactive resin can be proceeded more reliably by using a releasing compound with the hydroxyl group value of 30 mgKOH/g or more and 70 mgKOH/g or less. Further, since the reactivity with the reactive resin can be controlled easily, the physical property value of the release agent of the invention can be controlled easily.

The acid value of the releasing compound means the number of mg for potassium hydroxide necessary for neutralizing the acidic group contained in one g of the releasing compound, which is determined by a neutralizing titration method. Further, the hydroxyl group value of the releasing compound means the number of mg for potassium hydroxide necessary for the neutralizing free acetic acid obtained by hydrolyzing an acetylation product obtained form one g of the releasing compound, which is determined by a back titration method.

As the reactive resin having the reactive functional group, resins used as the binder resin for the toner or those using such resin as a pre-polymer and introducing the reactive functional group to the pre-polymer can be used. The reactive functional group of the reactive resin includes, for example, alkoxycarbonyl group (—COOR (R represents alkyl group)), carboxyl group, amino group, alcoholic hydroxyl group, isocyanate group (—N—C═O), and epoxy group. The reactive resin or the resin used as the pre-polymer of the reactive resin includes, for example, polyester resin, polyurethane resin, epoxy resin, acryl resin, and styrene acryl resin.

As the polyester resin, known resins can be used with no particular restriction and include, for example, polycondensation products of polybasic acids and polyhydric alcohols. The polybasic acids are polybasic acids and derivatives thereof, for example, acid anhydrides or esterification products of polybasic acids. Further, polyhydric alcohols are compound containing two or more of hydroxyl groups and include both alcohols and phenols.

For the polybasic acids, those used as the monomer for polyester resins can be used and include, for example, aromatic carboxylic acids such as terephthalic acid, isophthalic acid, phthalic acid anhydride, trimellitic acid anhydride, pyromeritic acid, and naphthalene dicarboxylic acid, and aliphatic carboxylic acids such as maleic acid anhydride, fumaric acid, succinic acid, and adipic acid. The polybasic acids can be used each alone or two or more of them can be used in combination.

Also for the polyhydric alcohols, those used customarily as the monomers for the polyester resins can be used and include, for example, aliphatic polyhydric alcohols such as ethylene glycol, propylene glycol, butanediol, hexanediol, neopenthyl glycol, and glycerin, cycloaliphatic polyhydric alcohols such as cyclonexanediol, cyclohexane dimethanol, and hydrogenated bisphenol A, and aromatic diols such as ethylene oxide adduct of bisphenol A and propylene oxide adduct of bisphenol A. Ethylene oxide (simply referred to as EO) adduct of bisphenol A includes, for example, polyoxyethylene-2,2-bis(4-hydrosyphenyl)propane. Propylene oxide (simply referred to as PO) adduct of bisphenol A includes, for example, polyoxypropylene-2,2-bis(4-hydroxyphenyl)propane. The polyhydric alcohols can be used each alone or two or more of them may be used in combination.

The polyester resins can be usually synthesized by polycondensation reaction. For example, they can be synthesized by polycondensation reaction, specifically, dehydrating condensation reaction of polybasic acids and polyhydric alcohols in an organic solvent or with no solvent under the presence of a catalyst. The polycondensation reaction may be stopped at the instance the acid value, the hydroxyl group value, and the softening temperature of the resultant polyester resin reach predetermined values. In the polycondensation reaction, the content of the carboxyl groups and the hydroxyl groups bonded to the terminal end or the side chains of the obtained polyester resin, that is, the acid value and the hydroxyl group value of the obtained polyester resin can be controlled and other physical property values such as the softening temperature can also be controlled by properly changing the blending ratio of the polybasic acids and the polyhydric alcohols, the reactivity, and the kinds of the polybasic acids and the polyhydric alcohols used.

Also the acryl resin is not particularly restricted and known resins can be used and include, for example, homopolymers of acrylic monomers or copolymers of acrylic monomers and vinylic monomers. Among them, acrylic resins having acidic groups are preferred. As the acrylic monomers, those used customarily as the monomers for the acrylic resins can be used and include, for example, acrylic acid, methacrylic acid, acrylate ester monomers such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate, methacrylate ester monomers such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate. The acrylic monomers may have a substituent and the acrylic monomer having the substituent includes, for example, acrylate ester or methacrylate ester monomers having hydroxyl groups, for example, hydroxyethyl acrylate and hydroxypropyl methacrylate. The acrylic monomers can be used each alone or two or more of them can be used in combination. Also for the vinyl monomers, known monomers can be used and include, for example, aliphatic vinyl monomers such as vinyl bromide, vinyl chloride, and vinyl acetate, and acrylonitrile monomers such as acrylonitrile and methacrylonitrile. The vinyl monomers can be used each alone or two or more of them can be used in combination.

The acrylic resin can be prepared, for example, by polymerizing one or more of acryl monomers, or one or more of acrylic monomers and one or more of vinylic monomers by a solution polymerization method, suspension polymerization method, or emulsion polymerization method under the presence of a radical initiator. The acrylic resin having the acidic group can be prepared, for example, by polymerizing acrylic monomers to each other or an acrylic monomer and a vinylic monomer while using the acrylic monomer containing the acid group or the hydrophilic group and/or vinylic monomer having the acidic group or hydrophilic group in combination.

Also the styrene acryl resin is not particularly restricted and known resins can be used and include copolymers of acrylic monomers and styrenic monomers. Among them, styrene acrylic resins having acidic group are preferred. The acrylic monomer includes monomers exemplified as the monomers for the acrylic resins described above. The acrylic monomers can be used each alone or two or more of them can be used in combination. For the styrenic monomer, those known monomers can be used and include, for example, aromatic vinyl monomer such as styrene and α-methyl styrene. The styrenic monomers can be used each alone or two or more of them can be used in combination.

The styrene acrylic resin can be prepared, for example, by polymerizing one or more of acrylic monomers and one or more of styrenic monomers, for example, by a solution polymerization method, suspension polymerization method, or emulsion polymerization method under the presence of a radical initiator. The styrene acrylic resin having the acidic group can be prepared, for example, by polymerizing the acrylic monomer and the styrenic monomer while using the acrylic monomer containing the acidic group or hydrophilic group and/or the styrenic monomer having the acidic group or hydrophilic group in combination.

Also the polyurethane resin is not particularly restricted and known resins can be used and include, for example, addition polymerization products of polyol and polyisocyanate. Among them, polyurethane resins having acidic group or basic group are preferred. The polyurethane resin having the acidic group or basic group can be synthesized, for example, by addition polymerizing reaction of polyols having acidic group or basic group and polyisocyanates. The polyol having the acidic group or basic group includes, for example, diols such as dimethylol propionic acid and N-methyldiethanolamine, tri or higher hydric polyols such as polyether polyol, for example, polyethylene glycol, polyester polyol, acryl polyol, and polybutadiene polyol. The polyols may be used each alone or two or more of them can be used in combination. The polyisocyanate includes, for example, tolylenediisocyanate, hexamethylenediisocyanate, and isophorone diisocyanate. The polyisocyanates can be used each alone or two or more of them can be used in combination.

Also the epoxy resin is not particularly restricted and known resins can be used and include, for example, bisphenol A epoxy resins synthesized from bisphenol A and epichorolohydrin, phenol novolac epoxy resins synthesized from phenol novolac as the reaction product of phenol and formaldehyde and epichlorohydrin, and cresol novolac epoxy resins synthesized from cresol novolac as the reaction product of cresol and formaldehyde and epichlorohydrin. Among them, epoxy resins having the acidic group or basic group are preferred. The epoxy resin having the acidic group or the basic group can be prepared, for example, by using the epoxy resin described above as a base and adding or addition polymerizing a polybasic carboxylic acid such as adipic acid or trimellitic acid anhydride, or amines such as dibutylamine or ethylene diamine to the epoxy resin as the base.

The reactive functional group of the reactive resin can be introduced, for example, by reacting the monomer having the reactive functional group during polymerization. Further, the reactive functional group can be introduced to the pre-polymer for preparing the reactive resin, for example, by a method of depolymerizing the pre-polymer together with polybasic carboxylic acids, polyhydric alcohols, polyvalent amines, etc. followed by polycondensation, or by a method of conducting polycondensation and depolymerization simultaneously. The polycondensation and the depolymerizing reaction in synthesizing the reactive resin can be conducted, for example, by an emulsion polymerization method.

The release agent of the invention can be synthesized, for example, by dehydrating condensation reaction of a reactive resin having the hydroxyl group and a releasing compound having the carboxyl group. This can obtain a release agent in which the reactive resin and the releasing compound are bonded by way of an ester bond. Further, a release agent in which the reactive resin and the releasing compound are bonded by way of the ester bond can be obtained also by an ester exchange reaction between the reactive resin having an alkoxy carbonyl group and the releasing compound having carboxyl group.

Further, a release agent in which the reactive resin and the releasing compound are bonded by way of a urea bond can be synthesized by reacting a reactive resin having an amino group and a releasing compound having an alcoholic hydroxyl group.

Further, a release agent in which the reactive resin and the releasing compound are bonded by way of a urethane bond can be synthesized by reacting a reactive resin having an isocyanate group and a releasing compound having an alcoholic hydroxyl group or phenol hydroxyl group.

A release agent comprising a branched resin having a main chain and side chains in which the main chain contains a compatible site and the side chains contain a releasing site having releasing ability can be obtained by using, as the reactive resin, a resin in which the reactive functional group is contained in the main chain, or a resin, as the reactive resin, having a reactive functional group as side chain or in the side chain in reaction between the reactive resin and the releasing compound. Considering the reactivity, it is preferred to use a resin having the reactive functional group on the side chains as the reactive resin.

In the reaction between the reactive resin and the releasing compound, the introduction ratio of the releasing compound to the reactive resin can be controlled by controlling the reactivity of the reactive functional groups of the reactive resin. For example, in a case of reacting the reactive resin having the reactive functional groups on the side chains and the releasing compound, the introduction ratio of the releasing compound to the reactive resin can be controlled and the ratio of the releasing compound bonded to the side chains can be controlled by controlling the side chain reactivity as the reactivity of the reactive functional group of the side chains. The reactivity of the reactive functional group can be controlled, for example, depending on the blending formulation and the treating condition (reaction condition) for the reactive resin and the releasing compound. For example, after synthesizing the release agent by blending the reactive resin and the releasing compound such that the total mol number for the reactive functional groups of the releasing compound is in excess of the total mol number for the reactive functional groups of the reactive resin, excess reactive functional groups of the releasing compound are inactivated and the inactivated releasing compound is removed. This can increase the reactivity of the reactive functional groups to 90% or more and the introduction ratio of the releasing compound to the reactive resin to 90% or more. Further, in a case of using the resin having the reactive functional groups on the side chains as the reactive resin, a release agent comprising the branched resin in which the main chain has a compatible site and the releasing compound is bonded as the releasing site to the side chains can be obtained more reliably by reacting the reactive resin and the releasing compound such that the side chain reactivity as the reactivity of the reactive functional group is 90% or more as described above, thereby increasing the introduction ratio of the releasing compound to the side chains of the reactive resin to 90% or more.

The weight average molecular weight of the side chains containing the releasing site of the release agent comprising the branched resin can be controlled, for example, by the molecular weight of the releasing compound having the reactive functional groups used as the starting material. Further, the weight average molecular weight of the main chain means the weight average molecular weight of the resin as the main chain before introduction of the side chains, that is, the weight average molecular weight of the reactive resin used as the starting material for the release agent.

While the reactive resin can be properly selected in accordance with the toner binder resin, polyester resins are preferred among the reactive resins described above in view of the easy introduction of the reactive functional group and the reactivity with the wax having the reactive functional group. By using the polyester resin as the reactive resin, the release agent of the invention in which the compatible site is formed of the polyester resin can be obtained.

The release agent of the invention in which the compatible site is formed of the polyester resin is excellent in the compatibility with the polyester resin and can be used suitably to a toner using the polyester resin as the binder resin. By using the release agent of the invention in which the compatible site is formed of the polyester resin for the toner containing the polyester resin as the binder resin, detachment of the release agent from the kneaded mass in heating the dispersion medium mixed with the kneaded mass can be prevented more reliably.

In order to further improve the compatibility with the polyester resin, the releasing site of the release agent of the invention is preferably formed of an ester compound having the ester bond. This can provide a release agent more suitable to toner using the polyester resin as the binder resin. In a case where the compatible site is formed of the polyester resin and the releasing site is formed of the ester compound, the release agent of the invention can be prepared, for example, by reacting the polyester resin with the ester compound having releasing ability. For such ester compound, the ester wax described above can be used.

The release agent of the invention described above is used suitably to a manufacturing method of a toner as a preferred embodiment of the invention. FIG. 1 is a flow chart showing procedures of the toner manufacturing method as a preferred embodiment of the invention. The toner manufacturing method according to the embodiment includes at least a melt-kneading step, a granulating step, and a separation step. This embodiment further includes an aqueous medium preparation step, a cooling step, a cleaning step, and a drying step. That is, the toner manufacturing method according to this embodiment includes a melt-kneading step (step s1), an aqueous medium preparation step (step s2), a granulating step (step s3), a cooling step (step s4), a separation step (step s5), a cleaning step (step s6), and a drying step (step s8). The preparation process of the toner according to this embodiment is started at step s0 and then transfers to step s1 or step s2. Either the melt-kneading step at step s1 or the aqueous medium preparation step at step s2 may be conducted previously. Further, the cleaning step at step s6 may be conducted either after the cooling step s4 or before the separation step s5.

[Melt-kneading Step]

In the melt-kneading step at step s1, a toner composition containing at least a binder resin, a colorant, and a release agent is melt-kneaded to obtain a kneaded mass. The toner composition may also contain additives other than the release agent such as a charge controller. The additives are kneaded together with the binder resin and the colorant and dispersed in the kneaded mass.

(a) Binder resin

As the binder resin, any resin that can be melted by heating can be used with no particular restriction.

While the softening temperature of the binder resin is not particularly restricted and can be selected properly from a wide range, it is preferably 150° C. or lower and, more preferably, 60° C. or higher and 150° C. or lower. In a case where the softening temperature of the binder resin exceeds 150° C., kneading with the colorant, the release agent, and the additives becomes difficult to possibly lower the dispersibility with the colorant and the additives. Further, the fixing property of the obtained toner to the transfer material may be lowered to possibly cause fixing failure. In a case where the softening temperature of the binder resin is lower than 60° C., the glass transition temperature (Tg) of the binder resin tends to be closer to the normal temperature, and the resin causes thermal coagulation in the inside of the image forming apparatus to possibly induce printing failure, disorder in the apparatus, etc.

while the glass transition temperature (Tg) of the binder resin is not particularly restricted and can be selected from a wide range, in view of the fixing property and the store stability of the obtained toner, it is preferably 30° C. or higher and 80° C. or lower. In a case where the glass transition temperature (Tg) of the binder resin is lower than 30° C., the store stability becomes insufficient tending to cause thermal coagulation of the toner in the inside of the image forming apparatus to possibly result in printing failure. In addition, the starting temperature for high temperature offset may possibly be lowered. In a case where the glass transition temperature (Tg) of the binder resin exceeds 80° C., the fixing property is lowered to possibly cause fixing failure.

While the molecular weight of the binder resin is not particularly restricted and can be properly selected from a wide range, it is preferably 5,000 or more and 500,000 or less as the weight average molecular weight. In a case where the weight average molecular weight of the binder resin is less than 5,000, the mechanical strength is lower than the mechanical strength necessary for the toner binder resin, the obtained toner particles are pulverized by stirring in the inside of the developing apparatus, etc. to possibly change the shape thereof and cause fluctuation in the charging performance. In a case where the weight average molecular weight of the binder resin exceeds 500,000, kneading with the colorant and the additives becomes difficult to possibly lower the dispersibility of the colorant and the additives. In addition, the glass transition temperature (Tg) of the binder resin tends to exceed 80° C. thereby lowering the fixing property to possibly cause fixing failure. The weight average molecular weight of the binder resin is a value converted as polystyrene measured by gel permeation chromatography (simply referred to as GPC).

Specific examples of the binder resin include, for example, polyester resin, polyurethane resin, epoxy resin, and acryl resin. The resins may be used each alone or two or more of them may be used in combination. Further, also for the identical kind of resin, plural species of resins different in one or more of molecular weight, monomer composition, etc. can be used together.

Among the resins described above, polyester resins are preferred in view of the powder fluidity, low temperature fixing property, etc. of the obtained toner particles. Further, since the polyester resin is excellent also in the light permeability and can provide a color toner of excellent secondary color reproducibility, it is suitable as the binder resin for use in color toners.

(b) Colorant

For the colorant to be mixed with the binder resin, any of known dyes, organic pigments, inorganic pigments, etc. used as toner colorants can be used. Specific examples of the colorant include the following colorants of respective colors. In the followings, C.I. means a color index.

Black colorant includes, for example, carbon black, copper oxide, manganese dioxide, aniline black, activated carbon, non-magnetic ferrite, magnetic ferrite, and magnetite.

Yellow colorant includes, for example, C.I. pigment yellow 17, C.I. pigment yellow 74, C.I. pigment yellow 93, C.I. pigment yellow 155, C.I. pigment yellow 180, and C.I. pigment yellow 185.

Orange colorant includes, for example, red yellow lead, molybdenum orange, permanent orange GTR, pyrazolon orange, Vulcan orange, indathrene brilliant orange RK, benzidine orange G, indathrene brilliant orange GK, C.I. pigment orange 31, and C.I. pigment orange 43.

Red colorant includes, for example, C.I. pigment red 19, C.I. pigment red 48:3, C.I. pigment red 57:1, C.I. pigment red 122, C.I. pigment red 150, and C.I. pigment red 184.

Purple colorant includes, for example, manganese purple, fast violet B, and methyl violet lake.

Blue colorant includes, for example, C.I. pigment blue 15, C.I. pigment blue 15:2, C.I. pigment blue 15:3, C.I. pigment blue 16, and C.I. pigment blue 60.

Green colorant includes, for example, chromium green, chromium oxide, pigment green B, malachite green lake, final yellow green G, and C.I. pigment green 7.

White colorant includes, for example, compounds such as zinc powder, titanium oxide, antimony white, and zinc sulfide.

The colorants may be used each alone or two or more of them of different colors may be used in combination. Further, plural colorants of identical color series can also be used in combination. While the ratio of using the colorant to the binder resin is not particularly restricted and can be selected properly from a wide range in accordance with the kind of the binder resin and the colorant and various conditions such as the characteristics required for the toner particles to be obtained, it is preferably 0.1 parts by weight or more and 20 parts by weight or less and, more preferably, 5 parts by weight or more and 15 parts by weight or less based on 100 parts by weight of the binder resin. In a case where the ratio of using the colorant is less than 0.1 parts by weight, no sufficient coloring power can be obtained and the amount of the toner required for forming images having a desired image density is increased to possibly increase the consumption amount of the toner. In a case where the ratio of using the colorant exceeds 20 parts by weight, the dispersibility of the colorant in the kneaded mass is lowered to result in a possibility that uniform toner cannot be obtained.

(c) Release agent

As the release agent, the release agent of the invention described above is used. The release agent of the invention is properly selected and used in accordance, for example, with the kind and the softening temperature of the resin used as the binder resin. For example, in a case of using a polyester resin for the binder resin, the release agent of the invention in which the compatible site is formed of a polyester resin is used preferably.

While the amount of use of the release agent of the invention is not particularly restricted and can be selected properly from a wide range in accordance with the kind and the content of other ingredients such as the binder resin or the colorant, and various conditions such as characteristics required for the toner to be manufactured, it is preferably at a weight ratio from one part by weight or more and 40 parts by weight or less based on 100 parts by weight of the binder resin. In a case where the amount of using the release agent of the invention is less than one part by weight based on 100 parts by weight of the binder resin, the effect of lowering the starting temperature for low temperature offset and effect of increasing the starting temperature for high temperature offset cannot possibly be provided sufficiently. In a case where the amount of using the release agent of the invention exceeds 40 parts by weight based on the 100 parts by weight of the binder resin, the dispersibility of the release agent of the invention in the kneaded mass is lowered possibly making it difficult to control the dispersion particle size of the releasing site of the release agent to a desired value. Further, the release agent of the invention tends to be exposed to the toner surface possibly tending to cause filming on the photoreceptor.

Further, as the release agent, a release agent other than the release agent of the invention may also be used together with the release agent of the invention. Among them, a release agent with less weight average molecular weight than that of the release agent of the invention (hereinafter referred to as "low molecular weight release agent") is preferably used together. By using the low molecular weight release agent together with the release agent of the invention, since the low molecular weight release agent can be transferred to the fixing roller in fixing the toner by a heat roller fixing method, the starting temperature for high temperature offset can be increased more reliably to improve the anti-high temperature offset property. Since the low molecular weight release agent has no compatible site having compatibility with the binder resin, when the dispersion medium mixed with the kneaded mass is heated in the granulating step to be described later it may possibly be detached from the kneaded mass. However, in this embodiment, since the release agent of the invention is contained in the kneaded mass, the low molecular weight release agent and the releasing site of the release agent of the invention can be made compatible to prevent detachment of the low molecular weight release agent from the kneaded mass in the granulating step.

For the low molecular weight release agent used together with the release agent of the invention, release agents used generally as the release agent of the toner can be used and they include, for example, natural waxes such as carnauba wax and rice wax, synthesis waxes such as polypropylene wax, polyethylene wax, and Fisher-Tropcsh wax, coal type waxes such as monthan wax, petroleum type waxes such as paraffin wax, alcohol waxes, and ester waxes. The release agents are releasing compound used also as the starting material for the release agent of the invention. The amount of using the low molecular weight release agent is preferably 3 parts by weight or more and 20 parts by weight or less and, more preferably, 8 parts by weight or more and 20 parts by weight of less based on 100 parts of the binder resin. In a case where the amount of using the low molecular weight release agent is less than 3 parts by weight based on 100 parts by weight of the binder resin, the effect of improving the anti-high temperature offset property cannot possibly be provided sufficiently. Further, in a case where the amount of using the low molecular weight release agent exceeds 20 parts by weight based on 100 parts by weight of the binder resin, detachment of the low molecular weight release agent from the kneaded mass is caused in the granulating step and the effect by the use of the release agent of the invention cannot possibly be provided sufficiently.

(d) Other additives

As additives other than the release agent, general toner additives such as a charge controller can be used. As the charge controller, those customarily used in the relevant field can be used and they include, for example, calix arens, quaternary ammonium salt compounds, nigrosin type compounds, organic metal complexes, chelate compounds, metal salts of salicylic acid such as zinc salicylate and high molecular compounds obtained by homopolymerizing or copolymerizing monomers having ionic groups such as sulfonic acid group or amino group. The charge controllers may be used each alone or two or more of them may be used in combination. While the blending amount of the charge controller is not particularly restricted and can be selected properly from a wide range in accordance with various conditions such as the kind and the content of other ingredients, for example, the binder resin or the colorant, and the characteristic required for the toner to be manufactured, it is, preferably, from 0.5 parts by weight or more and 5 parts by weight or less based on 100 parts by weight of the binder resin.

The kneaded mass can be obtained by dry-mixing appropriate amounts of the binder resin, the colorant, and the release agent described above and an appropriate amount of additives in a case of adding various kinds of additives such as the charge controller as described above in a mixer, and heating and melt-kneading them at a temperature higher than the softening point and lower than the heat decomposition temperature of the binder resin, specifically, at about 80 to 200° C., preferably, at about 100 to 150° C. The toner composition such as the binder resin, the colorant, and the release agent may be melt-kneaded as they are without dry mixing. However, melt-kneading after dry mixing as in this embodiment is more preferred since the dispersibility of each of the ingredients such as the colorant to the binder resin can be improved to make the characteristic such as the charging performance of the obtained toner more uniform.

As the mixer used for dry mixing, known mixers can be used and include, for example, Henschel-type mixing apparatus such as Henschel mixer (trade name of product, manufactured by Mitsui Mining Co. Ltd.), super mixer (trade name of product, manufactured by Kawata System Engineering), and mechano mill (trade name of product, manufactured by Okada Precision Instruments Co.), ongu mill (trade name of product, manufactured by Hosokawa Micron Co.), hybridization system (trade name of product, manufactured by Nara Machinery Co.), and cosmo system (trade name of product, manufactured by Kawasaki Heavy Industries Ltd.). For the melt kneading, general kneading machines such as kneader, twin screw extruder, two roll mill, three roll mill, and laboblast mill can be used, and such kneading machines include, for example, single or twin screw extruders such as TEM-100B (trade name of product, manufactured by Toshiba Machine Co.), PCM-65/87, PCM-30 (each trade name of product, manufactured by Ikegai Co.), and open roll type kneaders such as kneadex (trade name of product, manufactured by Mitsui Mining Co. Ltd.). The melt-kneading may also be conducted by using plural kneading machines.

[Aqueous Medium Preparation Step]

In this embodiment, an aqueous medium containing a dispersant and water is used as a dispersion medium for dispersing the kneaded mass in the granulating step. In the aqueous medium preparation step at step s2, an aqueous medium containing a dispersant and water (hereinafter referred to as "dispersant-containing aqueous medium") is prepared. In the dispersant-containing aqueous medium, while the dispersant may be in a state dissolved in or dispersed in water, it is preferred that the dispersant is dissolved in water for efficiently conducting granulating of the kneaded mass in the granulating step at step s3 to be described later. That is, as the dispersant, a material soluble to water is preferably used. In a case of using a material not soluble to water is used as the dispersant, since the dispersant is present as a solid in a mixture of the kneaded mass and the dispersant-containing aqueous medium, the dispersant behaves like a boiling chip in the granulating step to form fine bubbles on the surface of the dispersant and bubbling occurs from the bubbles as the activation point which may possibly hinder stirring conducted by the stirring device and, thus, hinder pulverization of the kneaded mass making the granulating impossible. Since the generation of bubbles from the dispersant can be prevented in the granulating step by using a material soluble to water as the dispersant, the kneaded mass can be granulated efficiently. Further, since the water soluble material can easily be removed in the cleaning step at step s6 to be described later, it also has an advantage capable of preventing the residue of the dispersant to the obtained toner.

The water soluble dispersant includes, for example, water soluble polymeric compounds and surfactants. The water soluble polymeric compounds include, for example, styrene-vinyl carboxylic acid copolymers such as styrene-maleic acid copolymer and styrene-acrylic acid copolymer, polyvinyl alcohol, polyvinyl pyrrolidone, and hydroxyl cellulose. As the surfactants, any of nonionic surfactants, anionic surfactants, and cationic surfactants may be used and specific examples include, for example, sodium dodecyl sulfate, sodium tetradecyl sulfate, sodium pentadecyl sulfate, sodium octyl sulfate, sodium oleate, sodium laurate, potassium stearate, and calcium oleate. The dispersant may be used each alone or two or more of them can be used in combination.

Among the water soluble dispersants described above, use of the water soluble polymeric compounds is preferred and, among them, the styrene-vinyl carboxylic copolymers are used preferably. In the case of using the surfactant, there may be a possibility of causing bubbling of the mixture in the granulating step at step s3 to possibly hinder the granulating of the kneaded mass. By using the water soluble polymeric compound for the dispersant, bubbling as in the case of using the surfactant can be prevented and granulating of the kneaded mass in the granulating step at step s3 can be conducted more efficiently.

The water soluble polymeric compound has a weight average molecular weight of 5,000 or more and 50,000 or less and, more preferably, 5,000 or more and 20,000 or less. In a case where the weight average molecular weight of the water soluble polymeric compound is less than 5,000, unreacted monomers may sometimes remain in the water soluble polymeric compounds and it may not possibly function sufficiently as the dispersant. In a case where the weight average molecular weight of the water soluble polymeric compound exceeds 50,000, the water solubility is worsened to possibly hinder the granulating of kneaded mass. The weight average molecular weight of the water soluble polymeric compound is a value converted as polystyrene measured by gel permeation chromatography (simply referred to as GPC).

While the content of the dispersant, that is, the concentration of the dispersant in the dispersant-containing aqueous medium is not particularly restricted and can be selected properly from a wide range, it is preferably 5% by weight or more and 40% by weight or less based on the entire dispersant-containing aqueous medium in the dispersant-containing aqueous medium at a room temperature (about 25° C.), in view of the operability in mixing the kneaded mass and the dispersant-containing aqueous medium, the dispersion stability of the granulated particles, etc. In a case where the concentration of the dispersant is less than 5% by weight, since a great amount of the dispersant-containing aqueous medium is necessary for attaining a preferred ratio of using the dispersant relative to the kneaded mass in the granulating step at step s3 to be described later, this complicates the mixing operation for the kneaded mass and the dispersant-containing aqueous medium. In a case where the concentration of the dispersant exceeds 40% by weight, since the viscosity of the dispersant-containing aqueous medium increases tending to form bubbles, it is difficult to stably disperse the resultant granulated particles in the mixture.

The dispersant-containing aqueous medium can be prepared, for example, by dissolving or dispersing an appropriate amount of the dispersant described above in water. As water, water having an electric conductivity of 20 μS/cm or less is used preferably. Water with the electric conductivity in the range described above can be prepared, for example, by an activated carbon method, ion exchange method, distillation method, or reverse osmosis method. Further, among the methods described above, two or more of them may also be combined to prepare water with the electric conductivity in the range described above. Further, it can be prepared using, for example, commercial purified water producing apparatus, for example, Minipure TW-300RU (trade name of product) manufactured by Nomura Micro Science Co.

[Granulating Step]

In the granulating step at step s3, after mixing the kneaded mass obtained by melt-kneading at step s1 and the dispersant-containing aqueous medium prepared at step s2, the obtained mixture is heated and stirred and the kneaded mass in the mixture is granulated into particles as the toner particles.

While the heating temperature at the step is not particularly restricted and can be selected properly from a wide range in accordance with the kind of the binder resin contained in the kneaded mass and the characteristic thereof (for example, weight average molecular weight and softening temperature), and the particle size of the toner particles to be obtained finally, and it is preferably at or higher than the softening temperature of the binder resin contained in the kneaded mass and at or lower than the heat decomposition temperature of the binder resin. Also the pressure is not particularly restricted and a pressure capable of conducting the mixing operation easily to obtain toner particles having desired particle size and shape may be selected properly in accordance with the kind of the binder resin contained in the kneaded mass. However, in a case where the heating temperature is 100° C. or higher, the mixing operation is conducted preferably in a pressurized state, that is, at a pressure exceeding 1 atm in order to prevent boiling of the dispersant-containing aqueous medium.

In this embodiment, the release agent of the invention in which a releasing site having releasing ability is chemically bonded with a compatible site having compatibility with the binder resin is used as the release agent. Accordingly, in a case where the aqueous medium as the dispersant is heated, even when it is heated, for example, to higher than the melt point or the softening temperature of the releasing site of the release agent of the invention, detachment of the release agent of the invention from the kneaded mass can be prevented. Further, also in a case of using the release agent other than the release agent of the invention such as the low molecular weight release agent described above, detachment of the low molecular weight release agent from the kneaded mass of the release agent can be prevented by using it together with the release agent of the invention. Accordingly, deposition of the liberated release agent to the granulated particles of the kneaded mass can be prevented.

Further, since detachment of the release agent such as the release agent of the invention and the low molecular weight release agent from the kneaded mass can be prevented as described above and, accordingly, the heating temperature of the aqueous medium as the dispersion medium can be increased with no detachment of the release agent from the kneaded mass, the kneaded mass can be granulated more easily.

The stirring speed for the mixture of the kneaded mass and the dispersant-containing aqueous medium is not particularly restricted and a value capable of practicing the stirring operation easily to obtain granulated particles of the kneaded mass having desired particle size, grain size distribution, and shape can be selected properly in accordance with the binder resin, the colorant, the release agent of the invention and various other additives contained in the kneaded mass. Further, the stirring time for the mixture of the kneaded mass and the dispersant-containing aqueous medium is not particularly restricted and can be properly selected from a wide range in accordance with various kinds of conditions such as the kind and the amount of use of the binder resin in the kneaded mass, and the kind and the concentration of the dispersant in the dispersant-containing aqueous medium, and the heating temperature, and it is, for example, about from 10 to 20 min.

As the kneaded mass, those obtained by melting and kneading the binder resin, the colorant, and the release agent of the invention may be used as they are, or solidification mass obtained by cooling after melt-kneading may be used as they are, or those returned into the molten state by re-heating may also be used.

While the ratio of mixing the kneaded mass and the dispersant-containing aqueous medium is not particularly restricted and can be selected properly from a wide range in accordance with various conditions such as the content of the binder resin in the kneaded mass, and the kind and the content of the dispersant in the dispersant-containing aqueous medium, it is preferred to use 100 to 500 parts by weight of the dispersant-containing aqueous medium based on 100 parts by weight of the kneaded mass, with the view point of efficiently practicing the mixing operation, the subsequent cleaning operation for granulated particles of kneaded mass, and the isolation operation of toner particles.

More specifically, the kneaded mass and the dispersant-containing aqueous medium are mixed by using, for example, an emulsifying machine or a dispersing machine. Preferably, the emulsifying machine and the dispersing machine are those apparatus capable of receiving the kneaded mass and the dispersant-containing aqueous medium batchwise or continuously, having a heating section, or a heating section and a pressurizing section, capable of mixing the kneaded mass and the dispersant-containing aqueous medium under heating or under heating and pressure, producing particles of kneaded mass, and discharging the granulated particles batchwise or continuously. Further, the emulsifying machine and the dispersing machine are preferably those having a stirring section and capable of mixing the kneaded mass and the dispersant-containing aqueous medium under stirring. Further, the emulsifying machine and the dispersing machine are preferably those in which the mixing container for mixing the kneaded mass and the dispersant-containing aqueous medium has a temperature control section. The mixing container preferably has pressure proofness and, more preferably, has pressure proofness and a pressure control valve. By using the mixing container as described above, the temperature of the mixture in the container is maintained substantially constant and also the pressure is controlled to a predetermined pressure in view of the balance between the melting temperature of the binder resin and the vapor pressure of the dispersant-containing aqueous medium. In a case of mixing the kneaded mass and the dispersant-containing aqueous medium at a heating temperature of 100° C. or higher, since this is used in a pressurized state, it is desirable that the emulsifying machine and the dispersing machine have a mechanical seal and the mixing container can be closed tightly.

The emulsifying machine and the dispersing machine described above are commercially available. Specific examples include, for example, batchwise emulsifying machines such as Ultratalax (trade name of product, manufactured by IKA Japan Co.), Polytron homogenizer (trade name of product, manufactured by Kinematica AG.), and T.K. automohomixer (trade name of product, manufactured by PRIMIX Corp.), continuous emulsifying machines such as Ebara milder (trade name of product, manufactured by Ebara Corporation), T.K. pipeline homomixer, T.K. homomic line flow, T.K. fill mix (each trade name of product, manufactured by PRIMIX Corp.), colloid mill (trade name of product, manufactured by Shinko Pantec Co.), Slasher, Trigonal wet fine pulverizer (each trade name of product, manufactured by Mitsui Mining Co., Ltd.), Cavitron (trade name of product, manufactured by Eurotec Ltd.), Fine flow mill (manufactured by Pacific Machinery and Engineering Co., Ltd.), Clearmix (trade name of product, manufactured by M Technic Co.), and Filmix (trade name of product, manufactured by PRIMIX Corp.).

As described above, by heating and stirring the mixture of the kneaded mass and the dispersant-containing aqueous medium, granulated particles of kneaded mass containing at least the colorant and the release agent of the invention (hereinafter also referred to as a toner material) are produced in the mixture of the kneaded mass and the dispersant-containing aqueous medium.

[Cooling Step]

In the cooling step at step s4, the mixture containing the granulated particles of kneaded mass (hereinafter also referred to as an aqueous slurry) is cooled. Cooling for the aqueous slurry is preferably conducted after producing the particles of the kneaded mass in the granulating step at step s3 and stopping heating, by compulsory cooling the slurry using a coolant or by spontaneous cooling of allowing to cool the same as it is.

In the granulating step, since granulating is conducted by heating the mixture of the kneaded mass and the dispersant-containing aqueous medium to render the kneaded mass into a molten state, the granulated particles just after formation are in a molten state and have tackiness. While the granulated particles adhere to each other and tend to grow in this state, since the dispersant is contained together with the granulated particles in the mixture in this embodiment, the kneaded mass particles are stabilized by the dispersant and dispersed uniformly in the mixture. Accordingly, the granulated particles do not grow and the granulated particles can be cooled with the shape and the size being retained as they are in a state uniformly dispersed in the mixture. Accordingly, toner particles with a volume average particle size, for example, as small as about 3 to 8 μm with a narrow grain size distribution and having uniform shape and size can be obtained.

The mixture (aqueous slurry) is preferably cooled under stirring. In a case where the mixture is cooled without stirring, when the temperature of the mixture is higher than the softening temperature of the binder resin contained in the granulated particles, the dispersion stabilizing effect by the dispersant cannot be provided sufficiently to possibly fuse the granulated particles to each other. Accordingly, also in the cooling step, it is preferred to continue stirring of the mixture (aqueous slurry).

Further, in a case of granulating kneaded mass under pressure at a heating temperature for the mixture of 100° C. or higher, pressurization is preferably continued also in the cooling step. At a temperature of the mixture of 100° C. or higher, when the pressurization is stopped to return the pressure in the mixing container into an atmospheric pressure, since the aqueous slurry boils to evolve a great amount of bubbles, the subsequent treatment is difficult. The pressure in the mixing container is preferably returned to the atmospheric pressure when the temperature of the mixture in the mixing container is 50° C. or lower and, more preferably, returned to the atmospheric pressure after cooling of the mixture in the mixing container to a room temperature (about 25° C.).

[Separation Step]

In the separation step at step s5, the granulated particles are separated and recovered from the mixture after cooling. The granulated particles can be separated from the mixture in accordance with the known method and this can be conducted, for example, by filtration, filtration under sucking, centrifugal separation, etc.

[Cleaning Step]

In the cleaning step at step s6, the granulated particles separated from the mixture are cleaned. Cleaning for the granulated particles is applied in order to remove the dispersant and impurities derived from the dispersant. In a case where the dispersant and the impurities remain in the toner particles, there may be a possibility that the charging performance of the obtained toner particles becomes instable and the chargeability may possibly be lowered due to the effect of moisture in air.

The granulated particles can be cleaned, for example, by water washing. Water used for water washing is preferably water having electric conductivity of 20 μS/cm or less. Such water can be prepared, for example, by an activated carbon method, anion exchange method, a distillation method, or reverse osmosis method. Further, water may also be prepared by combining two or more of the methods described above. Water washing of the granulated particles may be conducted either batchwise or continuously. Further, while the temperature of the cleaning water is not particularly restricted, it is preferably within a range from 10 to 80° C.

Water washing of the granulated particles is preferably conducted repetitively until the electric conductivity of the cleaning water is lowered to 100 μS/cm or less, preferably, 10 μS/cm or less after cleaning the granulated particles by using a conductivity meter or the like. This can more reliably prevent the dispersant and the impurity from remaining and can make the charged amount of toner particles more uniform. In this embodiment, the electric conductivity of the cleaning water after cleaning the granulated particles is measured at step s7 and, in a case where the electric conductivity of the cleaning water is at a predetermined value or less, specifically, 100 μS/cm or less, the process goes to the drying step at step s8, whereas in a case where the electric conductivity of the cleaning water exceeds the predetermined value, the process returns to the separation step at step s5 and the separation step and the cleaning step are conducted repetitively.

The cleaning step at step s6 may also be conducted before the separation step at step s5. In this case, the granulated particles can be cleaned by water washing the granulated particles contained in the mixture after cooling. The water washing for the granulated particles is preferably conducted repetitively until the electric conductivity of supernatants separated from the mixture by centrifugation or the like lowers to 100 μS/cm or less, preferably, 10 μS/cm or less by using a conductivity meter. This can prevent the dispersant and the impurities from remaining more reliably to make the charged amount of the toner particles more uniform.

[Drying Step]

In the drying step at step s8, the granulated particles after cleaning are dried. Drying for the granulated particles as the toner particles can be practiced in accordance with a known method such as a freeze-drying method or an air blowing type drying method.

The thus obtained toner particles can be used as they are as the toner. Further, an external additive such as a surface modification can be added to the toner particles to modify the surface of the toner particles. The surface modifying agent includes, for example, silica or metal oxide particles such as of titanium oxide. Further, surface modifying agent applied with a surface modifying treatment such as a hydrophobic treatment by a silane coupling agent or the like may also be used. While the ratio of using the external additive to the toner particles is not particularly restricted, it is preferably 0.1 parts by weight or more and 10 parts by weight or less based on 100 parts by weight of the toner particles and it is, more preferably, one part by weight or more and 5 parts by weight or less.

As described above, the toner of the invention comprising toner particles or a composition containing toner particles and an external additive is obtained. When the toner of the invention is manufactured as described above, the process goes from step s8 to step s9 to complete manufacture of the toner according to this embodiment. In this embodiment, since detachment of the release agent from the kneaded mass in the granulating step can be prevented as described above, a toner having a desired visco-elasticity as per the design can be manufactured easily. Further, in this embodiment, since deposition of the liberated release agent to the granulated particles can be prevented, occurrence of high temperature offset phenomenon and filming on the photoreceptor due to deposition of the release agent can be prevented. Accordingly, a toner having a desired visco-elasticity, with a wider temperature range capable of fixing compared with a case of not using the release agent of the invention and causing no filming on the photoreceptor can be provided stably. Further, in this embodiment, since the kneaded mass is granulated in the aqueous medium under the presence of the dispersant, a toner having a volume average particle size, for example, as small as about 3 to 8 μm and with a narrow grain size distribution can be obtained without classification.

The toner of the invention obtained by the toner manufacturing method according to this embodiment can be used for the development of static charge images in the image formation by an electrophotographic method or electrostatic recording method, development of latent magnetic images in the image formation by a magnetic recording method or the like. Since the toner of the invention contains at least the release agent of the invention as the release agent with no inclusion of the liberated release agent and no deposition to the surface of the toner particles, use of the toner according to the invention can extend the temperature range capable of fixing which is a temperature range where the low temperature offset phenomenon and the high temperature offset phenomenon do not occur, as well as can suppress the occurrence of filming on the photoreceptor. Further, since the toner of the invention had a narrow grain size distribution and no fluctuation in the charging performance, it can be used suitably as a toner for developing static charge images used for the development of static charge images. That is, use of the toner of the invention can suppress the fluctuation of the charged amount of the toner, suppress the lowering of the image density and occurrence of white background fog and can form high quality images with no image defects. The toner according to the invention can be used as a one component developer or a two component developer.

EXAMPLES

While the invention is to be described specifically with reference to examples and a comparative example, the invention is no way restricted to them. In the followings, "part" and "%" mean "part by weight" and "% by weight" unless otherwise specified.

[Softening Temperature of Releasing Compound and Resin]

The softening temperature of the releasing compound and the resin used in the following preparation examples, examples and comparative example were measured as described below. Using a flow characteristic evaluation apparatus (trade name of product: flow tester CFT-500C, manufactured by Shimadzu Corp.), one g of a specimen was inserted in a cylinder and heated at a temperature elevation rate of 6° C./min while applying a load of 10 kgf/cm$^2$ so as to be extruded from the die and the temperature at which one-half of the specimen was caused to flow out of the die was determined as the softening temperature. A die having 1 mm diameter and 1 mm length was used.

[Glass Transition Temperature (Tg) of Releasing Compound and Resin]

The glass transition temperatures (Tg) for the releasing compound and the resin used in the following preparation examples, examples and comparative example were measured as described below. Using the differential scanning calorimetry (tradename of product: DSC220, manufactured by Seiko Instruments Inc.), 1 g of a specimen was heated at a temperature elevation rate of 10° C. per min to measure a DSC curve according to Japanese Industrial Standard (JIS) K7121-1987. A temperature at the crossing point between a line extending the base line on the high temperature side of an endothermic peak corresponding to the glass transition to the low temperature side and a tangential line drawn at the maximum point of the gradient relative to the curve from the rising portion of the peak to the apex of the peak in the obtained DSC curve is determined as a glass transition temperature (Tg).

[Melting Point of Wax]

The melting point of the wax used as the releasing compound in the following preparation examples was measured as described below. Using a differential scanning calorimeter (trade name of product: DSC220, manufactured by Seiko Instruments Co.), and a procedure of elevating the temperature for 1 g of the specimen from 20° C. to 150° C. at a temperature elevation rate of 10° C. per min and then rapidly cooling from 150° C. to 20° C. was repeated twice to determine a DSC curve. The temperature at the apex of an endothermic peak corresponding to melting of the DSC curve measured at the second operation was determined as the melting point of the wax.

[Acid Value of Releasing Compound and Resin]

The acid value of the releasing compound and the resin used in the following preparation examples, examples, and comparative example was measured by a neutralizing titration method as described below. After dissolving 5 g of a specimen in 50 mL of a mixed solvent of xylene and dimethyl formamide (1:1 weight ratio), and adding an ethanol solution of phenolphthalein as a indicator by several drops, titration was conducted with an aqueous solution of 0.1 mol/L potassium hydroxide (KOH). The point at which the color of the specimen solution turned from colorless to purple was determined as an end point and the acid value (mgKOH/g) was calculated based on the amount of the aqueous solution of potassium hydroxide required for reaching the end point and the weight of the specimen used for titration.

[Hydroxyl Value of Releasing Compound and Resin]

The hydroxyl value of the releasing compound and the resin used in the following preparation examples, examples, and comparative example was measured by the back titration method as described below. After adding and dissolving 5 mL of an acetylating reagent prepared separately to 2 g of a specimen, the obtained specimen solution was stood still for one hour while keeping the solution temperature at 100° C. The acetylating reagent was prepared by mixing 500 mL of pyridine, 70 g of phthalic acid, and 10 g of imidazol. Then, 1 mL of water, 70 mL of tetrahydrofuran, and several drops of an ethanol solution of phenolphthalein were added to the specimen solution, and titration was conducted with an aqueous solution of 0.4 mol/L sodium hydroxide (NaOH). The point at which the color of the specimen solution turned from colorless to purple was determined as an end point, and the hydroxyl group value (mgKOH/g) was calculated based on the amount of the aqueous solution of sodium hydroxide required to reach the end point and the amount of the specimen used for the titration.

[Weight Average Molecular Weight and Number Average Molecular Weight of Releasing Compound, Resin, and Dispersant]

The weight average molecular weight and the number average molecular weight of the releasing compounds, the resins, and the dispersants, used in the following preparation examples, the examples and the comparative examples as well as the release agent prepared in the preparation examples, were measured as described below. Using a GPC apparatus (trade name of product: HLC-8220GPC, manufactured by Tosoh Corp.), they were measured at a temperature of 40° C., using a tetrahydrofuran solution of 0.25 wt % specimen as a specimen solution, at a charged amount of 100 mL. The molecular weight calibration curve was prepared by using a standard polystyrene.

[Weight Average Molecular Weight for Side Chains of Release Agent Comprising Branched Resin]

The weight average molecular weight for the side chains of the release agent comprising the branched resin prepared in the following preparation examples (hereinafter also referred to as a wax-modified resin) was measured as described below.

At first, using a measuring apparatus for gel permeation chromatography-low angle light scattering (simply referred to as GPC-LALLS), the branching degree λ of the wax-modified resin was determined. The weight average molecular weight Mg for the side chains was determined from the obtained value for branching degree λ, the weight average molecular weight M1 of the reactive resin used as the starting material for the wax-modified resin and the weight average molecular weight M2 of the wax modified resin based on the following equation (1):

$$Mg=(M2-M1)/\lambda \quad (1)$$

[Volume Average Grain Particle Size and Fluctuation Coefficient]

The volume average particle size ($D_{50}$) and the fluctuation coefficient (CV) for the granulated particles (toner particles) manufactured in the following examples and comparative example were measured by using a grain size distribution measurement apparatus (trade name of product: Coaltar multisizer II, manufactured by Coaltar Co.). The number of measured particles was 50,000 count and the aperture diameter was set to 100 μm. A smaller fluctuation coefficient means a narrower grain size distribution.

[Dispersion Particle Size of Releasing Site in Release Agent]

The dispersion particle size of the releasing site in the release agent in the granulated particles (toner particles) manufactured in the following examples and comparative example was measured as described below.

At first, the granulated particles were subjected to coloring oxidization treatment to color only the wax portion as the releasing site, the cross section was observed by using a transmission electron microscope (simply referred to as TEM), the obtained cross sectional TEM images were analyzed by an image analyzer, the length for the major axis of the wax portion was measured for the release agent particles by the number of 50 contained in the granulated particles, and the average value for them was determined which was defined as a dispersion particle size of the wax portion.

Preparation Example

Preparation Example 1

[Preparation of Wax-modified Polyester Resin A1]

100 parts of a polyester resin as the reactive resin having a weight average molecular weight of 5,000, an acid value of 0 mgKOH/g, and a hydroxyl value of 55 mgKOH/g using polyethylene glycol, trimethylol propane, and adipic acid as the starting material was reacted with 85 parts of a carboxyl-terminated polyester resin as a wax as the releasing compound (manufactured by Unitika Ltd., trade name of product: ER-8101 (number average molecular weight of 2,000, softening temperature of 83° C., glass transition temperature (Tg) of 64° C., acid value of 62 mgKOH/g, and hydroxyl value of 0 mgKOH/g)) to obtain a wax-modified polyester resin A1 (acid value of 0 mgKOH/g, hydroxyl value of 3 mgKOH/g, weight average molecular weight of 9,500, side chain reactivity of 90% or more, weight average molecular weight for the side chains of 4,100, and Mb/Ma=0.82). The side chain reactivity is determined by calculation based on the result of the reaction for the charged amount of the starting materials used for the reaction.

Preparation Example 2

[Preparation of Wax-modified Polyester Resin A2]

100 parts of a polyester resin as the reactive resin having a weight average molecular weight of 35,000, an acid value of 0 mgKOH/g and a hydroxyl value of 59 mgKOH/g, using bisphenol A, polyethylene glycol, trimethylol propane, and adipic acid as starting material was reacted with 170 parts of a carboxyl-terminated polyester resin as a wax as the releasing compound (manufactured by Unitika Ltd., trade name of product: ER-8155 (number average molecular weight of 3,300, softening temperature of 87° C., glass transition temperature (Tg) of 64° C., acid value of 37 mgKOH/g, hydroxyl value of 0 mgKOH/g)) to obtain a wax-modified polyester resin A2 (acid value of 5 mgKOH/g, hydroxyl value of 0 mgKOH/g, weight average molecular weight of 43,000, side chain reactivity of 90% or more, weight average molecular weight of side chain of 6,100, and Mb/Ma=0.17).

Preparation Example 3

[Preparation of Wax-modified Polyester Resin A3]

100 parts of polyester resin as the reactive resin having a weight average molecular weight of 35,000, an acid value of 0 mgKOH/g, and a hydroxyl value of 59 mgKOH/g using bisphenol A, polyethylene glycol, trimethylol propane, and adipic acid as the starting material was reacted with 100 parts of a carboxyl-terminated polyester resin as a wax as the releasing compound (manufactured by Unitika Ltd., trade name of product: ER-8101 (number average molecular weight of 2,000, softening temperature of 83° C., glass transition temperature (Tg) of 64° C., acid value of 62 mgKOH/g, and hydroxyl value of 0 mgKOH/g)) to obtain a wax-modified polyester resin A3 (acid value of 4 mgKOH/g, hydroxyl value of 0 mgKOH/g, weight average molecular weight of 36,000, side chain reactivity of 90% or more, weight average molecular weight for side chain of 2,850, and Mb/Ma=0.08).

Example

[Preparation of Water]

In the following examples and comparative example, water used for preparing the dispersant-containing aqueous medium and for cleaning of the granulated particles (toner particles) was prepared from city water by using a super pure water preparation apparatus (trade name of product: Minipure TW-300RU manufactured by Nomura Micro Science Co.). The electric conductivity of water was measured by using Lacom tester EC-PHCON10 (trade name of product, manufactured by AS ONE Corporation).

Example 1

[Melt-kneading Step]

After mixing and dispersing 20 parts of a wax-modified polyester resin A1 prepared in Preparation Example 1, 80 parts of a polyester resin as a binder resin using bisphenol A (PO adduct), trimethylol propane, and isophthalic acid as starting materials (manufactured by Kao Corp.), 8 parts of carbon black as a colorant (trade name of product: NIPX60, manufactured by Degussa Co.), 2 parts of charge controller (trade name of product: TRH, manufactured by Hodogaya Chemical Industry Co.), and 5 parts of an ester wax as a low molecular weight release agent (trade name of product WEP-5, manufactured by NOF Corp.) for 3 min by a mixer (trade name of product: Henschel mixer, manufactured by Mitsui Mining Co. Ltd.), they were heated and melt-kneaded at a temperature of 130° C. by using a twin-screw extruder (trade name of product: PCM-30, manufactured by Ikegai Co.) to prepare a kneaded mass.

[Aqueous Medium Preparation Step]

To ion exchanged water (electric conductivity: 8 μS/cm) was mixed and dissolved a dispersant mixture of Johncryl 61/Johncryl 52 (manufactured by Johnson Polymer Co.) such that the solid concentration was 20 wt % to prepare an aqueous solution of a dispersant as a dispersant-containing aqueous medium (dispersant concentration: 20 wt %).

[Granulating Step]

To a metal mixing container provided with a pressure control valve, a heating section, and a rotor stator type stirring section, 100 parts of the kneaded mass and 400 parts of the dispersant aqueous solution (dispersant concentration: 20 wt %) prepared as described above were charged and stirred for 10 min while heating the mixture in the mixing container to a temperature of 150° C. to form granulated particles. In this case, the rotational speed of the rotor (30 mm outer diameter) of the rotor stator type stirring section was set to 10,000 rpm.

[Cooling Step]

After producing the granulated particles as described above, heating was stopped and the resultant mixture containing the granulated particles was cooled under stirring to a temperature of 20° C. The rotational speed of the rotor of the rotor stator type stirring section in the cooling step was set to 10,000 rpm.

[Separation Step, Cleaning Step, and Drying Step]

After cooling, the mixture containing the granulated particles was filtered to separate the granulated particles. Then, the granulated particles were cleaned by using ion exchanged water at a temperature of 20° C. (electric conductivity: 0.5 μS/cm). Cleaning was conducted repetitively until the electric conductivity of the cleaning water after cleaning the granulated particles was lowered to 10 μS/cm or less. After cleaning, the granulated particles were freeze-dried to obtain toner particles with a volume average particle size ($D_{50}$) of 5.0 μm and a fluctuation coefficient (CV) of 26.

To 100 parts of the obtained toner particles, 0.6 part of silica particles (trade name of product: Aerosil R976S, manufactured by Aerosil Co.) was mixed to obtain the toner of the invention.

Example 2

Toner particles were obtained in the same manner as in Example 1 except for changing the blending amount of the wax-modified polyester resin A1 to 10 parts, and changing the blending amount of the polyester resin as the binder resin to 90 parts. To 100 parts of the obtained toner particles, 0.6 part of the silica particles (trade name of product: Aerosil R976S, manufactured by Aerosil Co.) was mixed to obtain a toner of the invention.

Example 3

Toner particles were obtained in the same manner as in Example 1 except for changing the blending amount of the ester wax as the low molecular weight release agent to 15 parts. To 100 parts of the obtained toner particles, 0.6 part of the silica particles (trade name of product: Aerosil R976S, manufactured by Aerosil Co.) was mixed to obtain a toner of the invention.

Example 4

Toner particles were obtained in the same manner as in Example 1 except for using the wax-modified polyester resin A2 instead of the wax-modified polyester resin A1. To 100 parts of the obtained toner particles, 0. 6part of the silica particles (trade name of product: Aerosil R976S, manufactured by Aerosil Co.) was mixed to obtain a toner of the invention.

Example 5

Toner particles were obtained in the same manner as in Example 1 except for using the wax-modified polyester resin A3 instead of the wax-modified polyester resin A1. To 100 parts of the obtained toner particles, 0.6 part of the silica particles (trade name of product: Aerosil R976S, manufactured by Aerosil Co.) was mixed to obtain a toner of the invention.

Comparative Example 1

Toner particles were obtained in the same manner as in Example 1 except for not using the wax-modified polyester resin A1. To 100 parts of the obtained toner particles, 0.6 part of the silica particles (trade name of product: Aerosil R976S, manufactured by Aerosil Co.) was mixed to obtain a toner of the invention.

<Evaluation for Characteristic>

For each of the toners obtained in Examples 1 to 5 and Comparative Example 1, the anti-offset property and the anti-filming property were evaluated as described below.

[Anti-offset Property]

The obtained toner was charged in a developing device of a test image forming apparatus obtained by removing a fixing device from a commercial image forming apparatus having a non-magnetic one-component developing type developing device (trade name of product: LIBRE AR-C260, manufactured by Sharp Corp.), the toner deposition amount in the not-fixed state was controlled to 0.5 mg/cm$^2$, and rectangular solid images of 20 mm length×10 mm width were formed in a not fixed state to A4 size recording paper according to Japanese Industrial Standards (JIS) P0138 with a margin for 5 mm from the paper passing top end being provided to the top end in the paper passing direction. Using an external fixing device, the formed not-fixed toner images were fixed at a paper passing speed of the recording paper at 120 mm/sec to form images for evaluation. For the external fixing machine, an oilless type fixing device mounted to the image forming apparatus described above (trade name of product: LIBRE AR-C260, manufactured by Sharp Corp.), which was modified such that it could be driven externally and the surface temperature of the heat roller could be set to an optional value was used. The outer diameter of the heat roller in the fixing device was 40 mm. The oilless type fixing device means a fixing device of conducting fixing without coating the release agent such as silicone oil to the heat roller.

The formed images for evaluation were visually observed and it was judged whether the toner was deposited or not to the recording paper at a portion where the heat roller was in contact after second rotation, that is, whether the offset phenomenon occurred or not.

The operation was repeated while increasing the surface temperature of the heat roller by 5° C. each time from 100° C. to 210° C., the range for the surface temperature of the heat roller where the offset phenomenon did not occur, and the range was determined as the width for the temperature range capable of fixing which was the temperature range capable of fixing the toner with no occurrence of the offset phenomenon (hereinafter referred to as a fixing temperature width) (° C.) The anti-offset property was evaluated as "Good" in a case where the fixing temperature width was 40° C. or more and evaluated as "Poor" in a case where the fixing temperature width was less than 40° C.

@181

[Anti-filming Property]

The obtained two component developer was charged in a developing device of a commercial image forming apparatus (trade name of product: LIBRE AR-S505, manufactured by Sharp Corp.), the toner deposition amount in the not fixed state was controlled to 0.5 mg/cm$^2$, and an actual continuous copying test of forming sample images including solid portions and character portions to 10,000 sheets of recording paper was conducted. After the actual continuous copying test, photoreceptor was taken out of the image forming apparatus, the surface of the photoreceptor was observed under an optical microscope to judge whether the filming occurred or not. The anti-filming property was evaluated as "Good" in a case where filming did not occur and evaluated as "Poor" in a case where filming occurred.

The foregoing evaluation results are shown in Table 1.

TABLE 1

| | Release agent Wax-modified polyester resin | | Low molecular weight release agent | Toner characteristic: Dispersion particle size for releasing site of release | Toner characteristic: Anti-offset property: Fixing temperature | | Toner characteristic: Anti-filming |
|---|---|---|---|---|---|---|---|
| Example | Kind | Parts | Wax (part) | agent (μm) | width (° C.) | Evaluation | property |
| Example 1 | A1 | 20 | 5 | 0.5 | 75 | Good | Good |
| Example 2 | A1 | 10 | 5 | 0.4 | 75 | Good | Good |
| Example 3 | A1 | 20 | 15 | 0.6 | 95 | Good | Good |
| Example 4 | A2 | 20 | 5 | 0.4 | 80 | Good | Good |
| Example 5 | A3 | 20 | 5 | 0.6 | 70 | Good | Good |
| Comparative Example 1 | A1 | 0 | 5 | — | 35 | Poor | Poor |

@183 From Table 1, it can be seen that the toners of Examples 1 to 5 using, as the release agent, the wax-modified polyester resin as the release agent of the invention are excellent for the anti-offset property and the anti-filming property compared with the toner of Comparative Example 1 not using the release agent of the invention. This is considered that since Examples 1 to 5 use, as the release agent of the invention, the wax-modified polyester resin in which the wax as the releasing compound is bonded to the polyester resin that is the resin compatible with the polyester resin as the binder resin, detaching amount of the release agent from the kneaded mass in the granulating step could be decreased compared with Comparative Example 1 not using the release agent of the invention.

@184 As described above, a toner excellent in the anti-offset property and the anti-filming property could be obtained by using, as the release agent, the release agent of the invention containing the compatible site having compatibility with the binder resin and a releasing site chemically bonded with the compatible site.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A release agent for use in a toner, said toner comprising a binder resin, said release agent comprising a compatible site having compatibility with the binder resin and said release agent further comprising a releasing site chemically bonding with the compatible site and having releasing ability, wherein the release agent is composed of a branched resin comprising a main chain and side chains, the main chain comprising the compatible site and the side chains comprising the releasing site.

2. The release agent of claim 1, wherein the release agent is obtained by reacting a reactive resin comprising the main chain and reactive functional groups and a releasing compound comprising reactive functional groups capable of reacting with the reactive functional groups of the reactive resin such that reactivity of the reactive functional groups of the reactive resin with the reactive functional groups of the releasing compound is 90% or more.

3. The release agent of claim 1, wherein a weight average molecular weight of the side chains containing the releasing site is 500 or more and 5,000 or less.

4. The release agent of claim 1, wherein the weight average molecular weight in the main chain is 2,500 or more and 50,000 or less.

5. The release agent of claim 1, wherein the compatible site is formed of a resin containing a constituent unit identical with a constituent unit constituting the binder resin.

6. The release agent of claim 1, wherein the binder resin is a polyester resin, the compatible site is formed of a polyester resin and the releasing site is formed of an ester compound having an ester bond.

7. A method for manufacturing a toner comprising:

a melt-kneading step of preparing a kneaded mass by mixing and melt-kneading at least a binder resin, a colorant and a release agent of claim 1;

a granulating step of producing particles of kneaded mass by mixing a kneaded mass containing at least a binder resin, a colorant and a release agent with a dispersion medium, heating and stirring the dispersion medium mixed with the kneaded mass; and a separation step of separating the granulated particles from the dispersion medium.

8. A toner obtained in such a manner that particles of a kneaded mass are produced by mixing the kneaded mass containing at least a binder resin, a colorant and a release agent with a dispersion medium, heating and stirring the dispersion medium mixed with the kneaded mass, and that the granulated particles are separated from the dispersion medium, the toner comprising the release agent of claim 1.

* * * * *